US009251670B2

(12) United States Patent
Aoki et al.

(10) Patent No.: US 9,251,670 B2
(45) Date of Patent: Feb. 2, 2016

(54) WAGERING GAME INCLUDING MULTIPLE ARRAYS OF REEL SYMBOLS

(71) Applicant: WMS Gaming Inc., Waukegan, IL (US)

(72) Inventors: Dion K. Aoki, Henderson, NV (US); Shawn C. Collette, Henderson, NV (US); Allon G. Englman, Chicago, IL (US); Joel R. Jaffe, Glenview, IL (US); Jeremy M. Hornik, Chicago, IL (US); Jeremie D. Moll, Chicago, IL (US); Daniel P. Louie, Chciago, IL (US); Pamela S. Smith, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 181 days.

(21) Appl. No.: 14/101,400

(22) Filed: Dec. 10, 2013

(65) Prior Publication Data

US 2014/0094265 A1 Apr. 3, 2014

Related U.S. Application Data

(63) Continuation of application No. 13/294,428, filed on Nov. 11, 2011, now Pat. No. 8,608,544.

(60) Provisional application No. 61/413,383, filed on Nov. 12, 2010.

(51) Int. Cl.
*A63F 9/00* (2006.01)
*G07F 17/34* (2006.01)

(52) U.S. Cl.
CPC ..... *G07F 17/34* (2013.01)

(58) Field of Classification Search
None
See application file for complete search history.

(56) References Cited

U.S. PATENT DOCUMENTS

| | | | |
|---|---|---|---|
| 5,531,448 | A | 7/1996 | Moody |
| 5,732,950 | A | 3/1998 | Moody |
| 5,807,172 | A | 9/1998 | Piechowiak |
| 5,823,873 | A | 10/1998 | Moody |
| 5,954,335 | A | 9/1999 | Moody |
| 5,976,016 | A | 11/1999 | Moody et al. |
| 5,997,401 | A | 12/1999 | Crawford |
| 6,007,066 | A | 12/1999 | Moody |
| 6,098,985 | A | 8/2000 | Moody |
| 6,120,378 | A | 9/2000 | Moody et al. |
| 6,159,095 | A | 12/2000 | Frohm et al. |

(Continued)

FOREIGN PATENT DOCUMENTS

| | | |
|---|---|---|
| WO | 2007/030786 | 3/2007 |
| WO | 2007/089410 | 8/2007 |

*Primary Examiner* — Seng H Lim
(74) *Attorney, Agent, or Firm* — Nixon Peabody LLP

(57) ABSTRACT

A gaming system displays a first array of symbols and a second array of symbols for a wagering game. The second array of symbols includes at least one second-array reel. The at least one second-array reel includes a predetermined sequence of symbols. The at least one second-array reel rotates the predetermined sequence of symbols to determine at least partially the second array of symbols. The second array is divided into at least two sub-arrays, the at least one second-array reel extending into the at least two sub-arrays. A controller selects at least one symbol from the first array and copies the at least one selected symbol into one or more positions in each of the at least two sub-arrays. The at least two sub-arrays is displayed with combinations of symbols including the at least one selected symbol. The controller evaluates the combinations to determine an outcome to the wagering game.

20 Claims, 19 Drawing Sheets

(56) References Cited

U.S. PATENT DOCUMENTS

| | | | | |
|---|---|---|---|---|
| 6,203,428 | B1 | 3/2001 | Giobbi et al. | |
| 6,270,412 | B1 | 8/2001 | Crawford et al. | |
| 6,280,328 | B1 | 8/2001 | Holch et al. | |
| 6,311,978 | B1 | 11/2001 | Moody | |
| 6,315,291 | B1 | 11/2001 | Moody | |
| 6,364,313 | B1 | 4/2002 | Moody | |
| 6,419,578 | B1 | 7/2002 | Moody et al. | |
| 6,517,074 | B1 | 2/2003 | Moody et al. | |
| 6,517,433 | B2 | 2/2003 | Loose et al. | |
| 6,533,273 | B2 | 3/2003 | Cole et al. | |
| 6,561,898 | B2 | 5/2003 | Moody | |
| 6,568,680 | B1 | 5/2003 | Moody et al. | |
| 6,612,574 | B1 | 9/2003 | Cole et al. | |
| 6,612,575 | B1 | 9/2003 | Cole et al. | |
| 6,652,377 | B1 | 11/2003 | Moody | |
| 6,652,378 | B2 | 11/2003 | Cannon et al. | |
| 6,656,040 | B1 | 12/2003 | Brosnan et al. | |
| 6,672,959 | B2 | 1/2004 | Moody et al. | |
| 6,755,738 | B2 | 6/2004 | Glasson et al. | |
| 6,832,957 | B2 | 12/2004 | Falconer | |
| 6,860,810 | B2 | 3/2005 | Cannon et al. | |
| 6,921,334 | B1 | 7/2005 | Bennett | |
| 6,955,356 | B2 | 10/2005 | Moody | |
| 6,964,418 | B2 | 11/2005 | Moody | |
| 7,011,581 | B2 * | 3/2006 | Cole et al. | 463/16 |
| 7,137,628 | B2 | 11/2006 | Moody | |
| 7,156,397 | B2 | 1/2007 | Moody et al. | |
| 7,156,735 | B2 | 1/2007 | Brosnan et al. | |
| 7,222,857 | B2 | 5/2007 | Moody | |
| 7,222,858 | B2 | 5/2007 | Moody | |
| 7,381,133 | B2 | 6/2008 | Thomas | |
| 7,404,762 | B2 | 7/2008 | Moody | |
| 7,431,644 | B2 | 10/2008 | Moody | |
| 7,494,413 | B2 | 2/2009 | Singer et al. | |
| 7,527,557 | B2 | 5/2009 | Jackson | |
| 7,601,062 | B2 | 10/2009 | Cole et al. | |
| 7,927,204 | B2 | 4/2011 | Debrabander et al. | |
| 8,105,145 | B2 | 1/2012 | Jaffe | |
| 8,251,794 | B2 | 8/2012 | O'Halloran | |
| 8,388,435 | B2 | 3/2013 | Anderson et al. | |
| 8,545,319 | B2 * | 10/2013 | Kaneko | 463/31 |
| 2003/0045354 | A1 | 3/2003 | Giobbi | |
| 2003/0083121 | A1 | 5/2003 | Cole et al. | |
| 2003/0216165 | A1 | 11/2003 | Singer et al. | |
| 2004/0033829 | A1 | 2/2004 | Pacey et al. | |
| 2005/0101368 | A1 | 5/2005 | Thomas | |
| 2005/0233794 | A1 | 10/2005 | Cannon et al. | |
| 2006/0025215 | A1 | 2/2006 | Thomas | |
| 2006/0281531 | A1 | 12/2006 | Takeda | |
| 2007/0060289 | A1 | 3/2007 | Hood | |
| 2007/0287529 | A1 * | 12/2007 | Kojima | 463/20 |
| 2008/0108409 | A1 | 5/2008 | Cole et al. | |
| 2008/0125209 | A1 | 5/2008 | Pacey et al. | |
| 2008/0274786 | A1 | 11/2008 | Wilson | |
| 2008/0274788 | A1 | 11/2008 | Wilson | |
| 2008/0287178 | A1 | 11/2008 | Berman et al. | |
| 2009/0131145 | A1 | 5/2009 | Aoki et al. | |
| 2009/0239631 | A1 | 9/2009 | Aoki et al. | |
| 2010/0004049 | A1 * | 1/2010 | Ching et al. | 463/20 |
| 2010/0016058 | A1 | 1/2010 | Englman et al. | |
| 2010/0173694 | A1 | 7/2010 | Tsuchida | |
| 2010/0197385 | A1 | 8/2010 | Aoki et al. | |
| 2010/0234092 | A1 | 9/2010 | Gomez et al. | |
| 2010/0248811 | A1 | 9/2010 | Jaffe et al. | |
| 2011/0105218 | A1 * | 5/2011 | Anderson et al. | 463/20 |
| 2011/0117987 | A1 | 5/2011 | Aoki et al. | |
| 2011/0117989 | A1 * | 5/2011 | Kennedy et al. | 463/20 |
| 2011/0223985 | A1 | 9/2011 | Mizue | |
| 2012/0115565 | A1 | 5/2012 | Schwerdling | |
| 2013/0017881 | A1 | 1/2013 | Watkins | |

* cited by examiner

WAGERING GAME INCLUDING MULTIPLE ARRAYS OF REEL SYMBOLS

This application is related to and claims priority to U.S. Provisional Patent Application Ser. No. 61/413,383, filed Nov. 12, 2010, and titled "Wagering Game Including Multiple Arrays of Reel Symbols," which is incorporated herein by reference in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to a gaming apparatus, and methods for playing wagering games, and more particularly, to wagering games that present multiple reels that arrange symbols into multiple arrays to determine an outcome for the wagering game.

BACKGROUND OF THE INVENTION

Gaming terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. For example, slot machines or gaming terminals that simulate slot machines present players with a randomly determined array of symbols, and combinations of these symbols in the array are evaluated to determine the outcome of the game. Players perceive a greater likelihood of winning money and find greater entertainment value in such machines or terminals when a greater variety of winning symbol combinations are provided.

SUMMARY OF THE INVENTION

According to aspects of the present invention, wagering games present multiple reels that arrange symbols into multiple arrays to determine an outcome for the wagering game.

In one example embodiment, a gaming system displays, in response to a wager, a first array of symbols and a second array of symbols for a wagering game. The second array of symbols includes at least one second-array reel. The at least one second-array reel includes a predetermined sequence of symbols. The at least one second-array reel rotates the predetermined sequence of symbols to determine at least partially the second array of symbols. The second array is divided into at least two sub-arrays, the at least one second-array reel extending into the at least two sub-arrays. A controller selects at least one symbol from the first array and copies the at least one selected symbol into one or more positions in each of the at least two sub-arrays. The at least two sub-arrays is displayed with combinations of symbols including the at least one selected symbol. The controller evaluates the combinations of symbols in the at least two sub-arrays to determine an outcome to the wagering game. In some cases, the controller evaluates the combinations of symbols in the at least two sub-arrays according to one or more paylines in each sub-array, the one or more paylines being determined by a selection of corresponding one or more paylines in the first array.

In another example embodiment, a gaming system displays, in response to a wager, a first array of symbols and a second array of symbols for a wagering game. The first array of symbols includes a number of columns and a number of rows. The first array includes at least one special symbol that extends across more than one row. A controller responds to the at least one special symbol in the first array and modifies at least one combination of symbols in the second array. The controller evaluates the combinations of symbols in the second array to determine an outcome to the wagering game.

Additional aspects of the invention will be apparent to those of ordinary skill in the art in view of the detailed description of various embodiments, which is made with reference to the drawings, a brief description of which is provided below.

Figure 1:
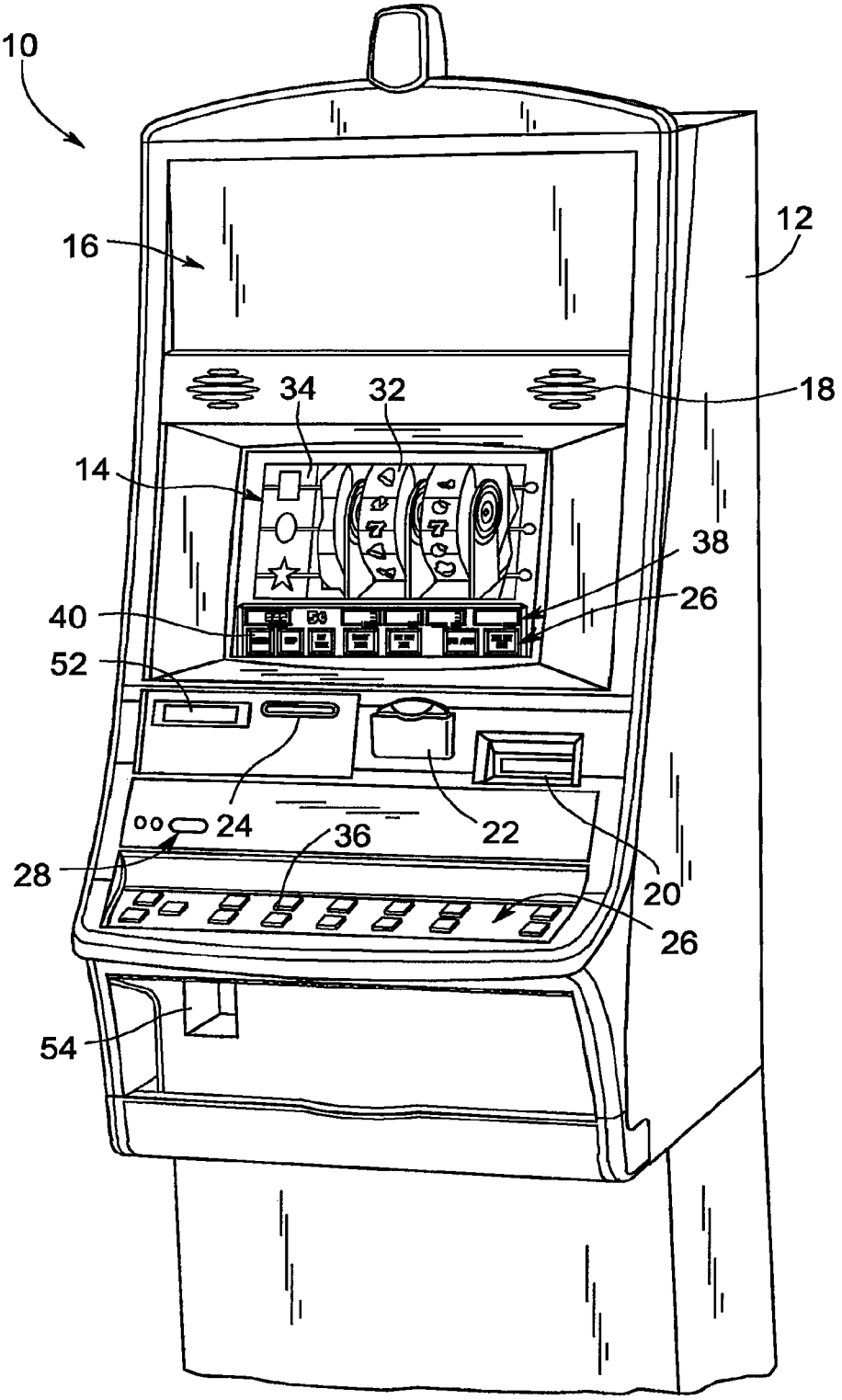
FIG. 1 (PRIOR ART)
FIG. 1 is a perspective view of a free-standing gaming terminal.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1, there is shown a gaming terminal 10 similar to those used in gaming establishments, such as casinos. With regard to the present invention, the gaming terminal 10 may be any type of gaming terminal and may have varying structures and methods of operation. For example, in some aspects, the gaming terminal 10 is an electromechanical gaming terminal configured to play mechanical slots, whereas in other aspects, the gaming terminal is an electronic gaming terminal configured to play a video casino game, such as slots, keno, poker, blackjack, roulette, craps, etc. It should be understood that although the gaming terminal 10 is shown as a free-standing terminal of the upright type, the gaming terminal is readily amenable to implementation in a wide variety of other forms such as a free-standing terminal of the slant-top type, a portable or handheld device primarily used for gaming, such as is disclosed by way of example in PCT Patent Application No. PCT/US2007/000792 filed Jan. 11, 2007, titled "Handheld Device for Wagering Games," which is incorporated herein by reference in its entirety, a mobile telecommunications device such as a mobile telephone or personal digital assistant (PDA), a counter-top or bar-top gaming terminal, or other personal electronic device, such as a portable television, MP3 player, entertainment device, etcetera.

The gaming terminal 10 illustrated in FIG. 1 comprises a cabinet or housing 12. For output devices, this embodiment of the gaming terminal 10 includes a primary display area 14, a secondary display area 16, and one or more audio speakers 18. The primary display area 14 and/or secondary display area 16 variously displays information associated with wagering games, non-wagering games, community games, progressives, advertisements, services, premium entertainment, text messaging, emails, alerts or announcements, broadcast information, subscription information, etc. appropriate to the particular mode(s) of operation of the gaming terminal. For input devices, the gaming terminal 10 illustrated in FIG. 1 includes a bill validator 20, a coin acceptor 22, one or more information readers 24, one or more player-input devices 26, and one or more player-accessible ports 28 (e.g., an audio output jack for headphones, a video headset jack, a wireless transmitter/receiver, etc.). While these typical components found in the gaming terminal 10 are described below, it should be understood that numerous other peripheral devices and other elements exist and are readily utilizable in any number of combinations to create various forms of a gaming terminal in accord with the present concepts.

The primary display area 14 include, in various aspects of the present concepts, a mechanical-reel display, a video display, or a combination thereof in which a transmissive video display is disposed in front of the mechanical-reel display to portray a video image in superposition over the mechanical-reel display. Further information concerning the latter construction is disclosed in U.S. Pat. No. 6,517,433 to Loose et al. entitled "Reel Spinning Slot Machine With Superimposed Video Image," which is incorporated herein by reference in its entirety. The video display is, in various embodiments, a cathode ray tube (CRT), a high-resolution liquid crystal display (LCD), a plasma display, a light emitting diode (LED), a DLP projection display, an electroluminescent (EL) panel, or any other type of display suitable for use in the gaming terminal 10, or other form factor, such as is shown by way of example in FIG. 1. The primary display area 14 includes, in relation to many aspects of wagering games conducted on the gaming terminal 10, one or more paylines 30 (see FIG. 3) extending along a portion of the primary display area. In the illustrated embodiment of FIG. 1, the primary display area 14 comprises a plurality of mechanical reels 32 and a video display 34, such as a transmissive display (or a reflected image arrangement in other embodiments), in front of the mechanical reels 32. If the wagering game conducted via the gaming terminal 10 relies upon the video display 34 only and not the mechanical reels 32, the mechanical reels 32 are optionally removed from the interior of the terminal and the video display 34 is advantageously of a non-transmissive type. Similarly, if the wagering game conducted via the gaming terminal 10 relies only upon the mechanical reels 32, but not the video display 34, the video display 34 depicted in FIG. 1 is replaced with a conventional glass panel. Further, in still other embodiments, the video display 34 is disposed to overlay another video display, rather than a mechanical-reel display, such that the primary display area 14 includes layered or superimposed video displays. In yet other embodiments, the mechanical-reel display of the above-noted embodiments is replaced with another mechanical or physical member or members such as, but not limited to, a mechanical wheel (e.g., a roulette game), dice, a pachinko board, or a diorama presenting a three-dimensional model of a game environment.

Video images in the primary display area 14 and/or the secondary display area 16 are rendered in two-dimensional (e.g., using Flash Macromedia™) or three-dimensional graphics (e.g., using Renderware™). In various aspects, the video images are played back (e.g., from a recording stored on the gaming terminal 10), streamed (e.g., from a gaming network), or received as a TV signal (e.g., either broadcast or via cable) and such images can take different forms, such as animated images, computer-generated images, or "real-life" images, either prerecorded (e.g., in the case of marketing/promotional material) or as live footage. The format of the video images can include any format including, but not limited to, an analog format, a standard digital format, or a high-definition (HD) digital format.

The player-input or user-input device(s) 26 include, by way of example, a plurality of buttons 36 on a button panel, as shown in FIG. 1, a mouse, a joy stick, a switch, a microphone, and/or a touch screen 38 mounted over the primary display area 14 and/or the secondary display area 16 and having one or more soft touch keys 40, as is also shown in FIG. 1. In still other aspects, the player-input devices 26 comprise technologies that do not rely upon physical contact between the player and the gaming terminal, such as speech-recognition technology, gesture-sensing technology, eye-tracking technology, etc. The player-input or user-input device(s) 26 thus accept(s) player input(s) and transforms the player input(s) to electronic data signals indicative of a player input or inputs corresponding to an enabled feature for such input(s) at a time of activation (e.g., pressing a "Max Bet" button or soft key to indicate a player's desire to place a maximum wager to play the wagering game). The input(s), once transformed into electronic data signals, are output to a CPU or controller 42 (see FIG. 2) for processing. The electronic data signals are selected from a group consisting essentially of an electrical current, an electrical voltage, an electrical charge, an optical signal, an optical element, a magnetic signal, and a magnetic element.

The information reader 24 (or information reader/writer) is preferably located on the front of the housing 12 and comprises, in at least some forms, a ticket reader, card reader, bar code scanner, wireless transceiver (e.g., RFID, Bluetooth, etc.), biometric reader, or computer-readable-storage-medium interface. As noted, the information reader may comprise a physical and/or electronic writing element to permit writing to a ticket, a card, or computer-readable-storage-medium. The information reader 24 permits information to be transmitted from a portable medium (e.g., ticket, voucher, coupon, casino card, smart card, debit card, credit card, etc.) to the information reader 24 to enable the gaming terminal 10 or associated external system to access an account associated with cashless gaming, to facilitate player tracking or game customization, to retrieve a saved-game state, to store a current-game state, to cause data transfer, and/or to facilitate access to casino services, such as is more fully disclosed, by way of example, in U.S. Patent Publication No. 2003/0045354, published on Mar. 6, 2003, entitled "Portable Data Unit for Communicating With Gaming Machine Over Wireless Link," which is incorporated herein by reference in its entirety. The noted account associated with cashless gaming is, in some aspects of the present concepts, stored at an external system 46 (see FIG. 2) as more fully disclosed in U.S. Pat. No. 6,280,328 to Holch et al. entitled "Cashless Computerized Video Game System and Method," which is incorporated herein by reference in its entirety, or is alternatively stored directly on the portable storage medium. Various security protocols or features can be used to enhance security of the portable storage medium. For example, in some aspects, the individual carrying the portable storage medium is required to enter a secondary independent authenticator (e.g., password, PIN number, biometric, etc.) to access the account stored on the portable storage medium.

Figure 2:
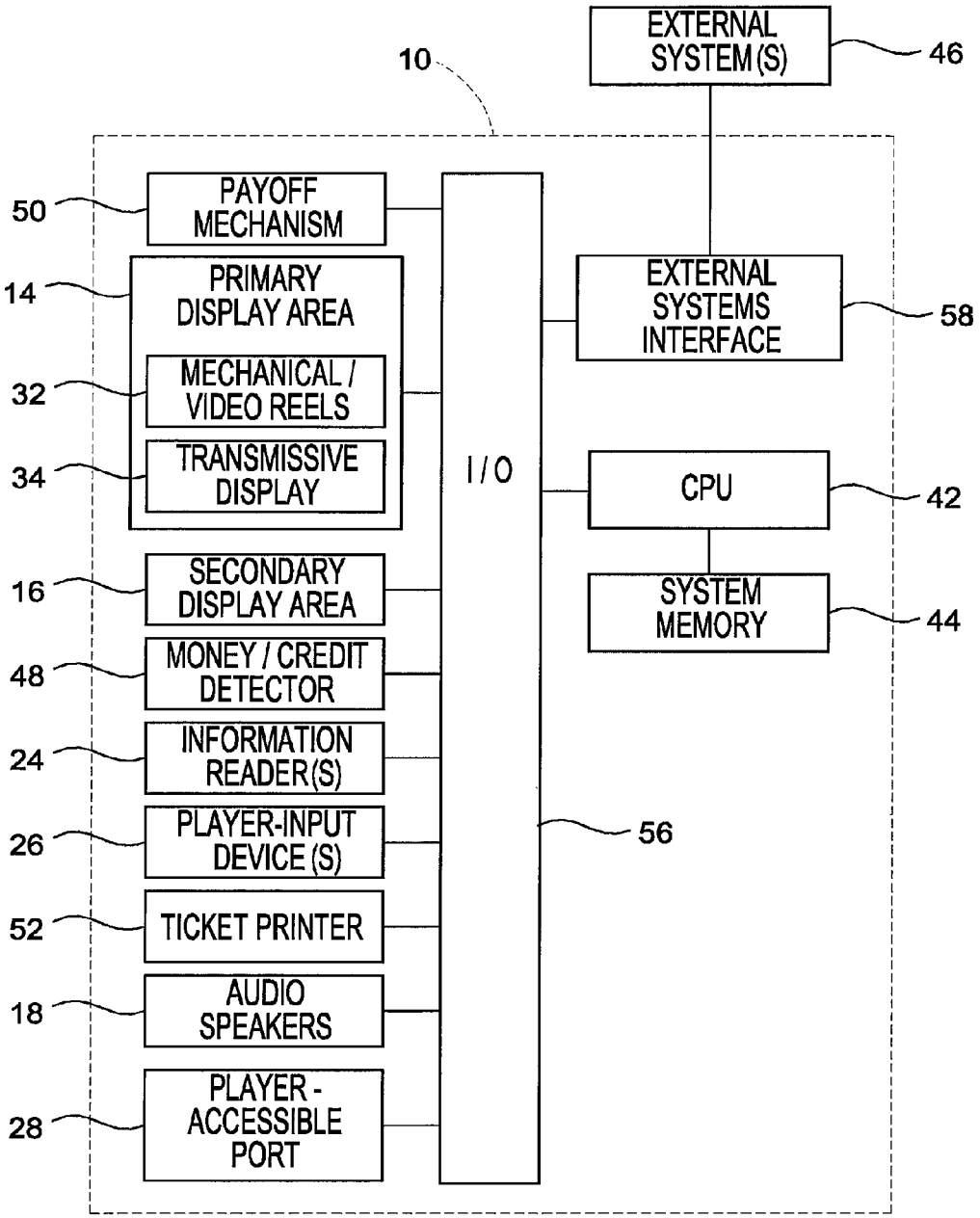
FIG. 2 (PRIOR ART)
FIG. 2 is a schematic view of a gaming system.

Turning now to FIG. 2, the various components of the gaming terminal 10 are controlled by one or more processors (e.g., CPU, distributed processors, etc.) 42, also referred to herein generally as a controller (e.g., microcontroller, microprocessor, etc.). The controller 42 can include any suitable processor(s), such as an Intel® Pentium processor, Intel® Core 2 Duo processor, AMD Opteron™ processor, or UltraSPARC® processor. By way of example, the controller 42 includes a plurality of microprocessors including a master processor, a slave processor, and a secondary or parallel processor. Controller 42, as used herein, comprises any combination of hardware, software, and/or firmware disposed in and/or disposed outside of the gaming terminal 10 that is configured to communicate with and/or control the transfer of data between the gaming terminal 10 and a bus, another computer, processor, or device and/or a service and/or a network. The controller 42 comprises one or more controllers or processors and such one or more controllers or processors need not be disposed proximal to one another and may be located in different devices and/or in different locations. For example, a first processor is disposed proximate a user interface device (e.g., a push button panel, a touch screen display, etc.) and a second processor is disposed remotely from the first processor, the first and second processors being electrically connected through a network. As another example, the first processor is disposed in a first enclosure (e.g., a gaming machine) and a second processor is disposed in a second enclosure (e.g., a server) separate from the first enclosure, the first and second processors being communicatively connected through a network. The controller 42 is operable to execute all of the various gaming methods and other processes disclosed herein.

To provide gaming functions, the controller 42 executes one or more game programs comprising machine-executable instructions stored in local and/or remote computer-readable data storage media (e.g., memory 44 or other suitable storage device). The term computer-readable data storage media, or "computer-readable medium," as used herein refers to any media/medium that participates in providing instructions to controller 42 for execution. The computer-readable medium comprises, in at least some exemplary forms, non-volatile media (e.g., optical disks, magnetic disks, etc.), volatile media (e.g., dynamic memory, RAM), and transmission media (e.g., coaxial cables, copper wire, fiber optics, radio frequency (RF) data communication, infrared (IR) data communication, etc). Common forms of computer-readable media include, for example, a hard disk, magnetic tape (or other magnetic medium), a 2-D or 3-D optical disc (e.g., a CD-ROM, DVD, etc.), RAM, PROM, EPROM, FLASH-EPROM, any other memory chip or solid state digital data storage device, a carrier wave, or any other medium from which a computer can read. By way of example, a plurality of storage media or devices are provided, a first storage device being disposed proximate the user interface device and a second storage device being disposed remotely from the first storage device, wherein a network is connected intermediate the first one and second one of the storage devices.

Various forms of computer-readable media may be involved in carrying one or more sequences of one or more instructions to controller 42 for execution. By way of example, the instructions may initially be borne on a data storage device of a remote device (e.g., a remote computer, server, or system). The remote device can load the instructions into its dynamic memory and send the instructions over a telephone line or other communication path using a modem or other communication device appropriate to the communication path. A modem or other communication device local to the gaming machine 10 or to an external system 46 associated with the gaming machine can receive the data on the telephone line or conveyed through the communication path (e.g., via external systems interface 58) and output the data to a bus, which transmits the data to the system memory 44 associated with the processor 42, from which system memory the processor retrieves and executes the instructions.

Thus, the controller 42 is able to send and receive data, via carrier signals, through the network(s), network link, and communication interface. The data includes, in various examples, instructions, commands, program code, player data, and game data. As to the game data, in at least some aspects of the present concepts, the controller 42 uses a local random number generator (RNG) to randomly generate a wagering game outcome from a plurality of possible outcomes. Alternatively, the outcome is centrally determined using either an RNG or pooling scheme at a remote controller included, for example, within the external system 46.

As shown in the example of FIG. 2, the controller 42 is coupled to the system memory 44. The system memory 44 is shown to comprise a volatile memory (e.g., a random-access memory (RAM)) and a non-volatile memory (e.g., an EEPROM), but optionally includes multiple RAM and multiple program memories.

As shown in the example of FIG. 2, the controller 42 is also coupled to a money/credit detector 48. The money/credit detector 48 is configured to output a signal the controller 42 that money and/or credits have been input via one or more value-input devices, such as the bill validator 20, coin acceptor 22, or via other sources, such as a cashless gaming account, etc. The value-input device(s) is integrated with the housing 12 of the gaming terminal 10 and is connected to the remainder of the components of the gaming terminal 10, as appropriate, via a wired connection, such as I/O 56, or wireless connection. The money/credit detector 48 detects the input of valid funds into the gaming terminal 10 (e.g., via currency, electronic funds, ticket, card, etc.) via the value-input device(s) and outputs a signal to the controller 42 carrying data regarding the input value of the valid funds. The controller 42 extracts the data from these signals from the money/credit detector 48, analyzes the associated data, and transforms the data corresponding to the input value into an equivalent credit balance that is available to the player for subsequent wagers on the gaming terminal 10, such transforming of the data being effected by software, hardware, and/or firmware configured to associate the input value to an equivalent credit value. Where the input value is already in a credit value form, such as in a cashless gaming account having stored therein a credit value, the wager is simply deducted from the available credit balance.

As seen in FIG. 2, the controller 42 is also connected to, and controls, the primary display area 14, the player-input device(s) 26, and a payoff mechanism 50. The payoff mechanism 50 is operable in response to instructions from the controller 42 to award a payoff to the player in response to certain winning outcomes that occur in the base game, the bonus game(s), or via an external game or event. The payoff is provided in the form of money, credits, redeemable points, advancement within a game, access to special features within a game, services, another exchangeable media, or any combination thereof. Although payoffs may be paid out in coins and/or currency bills, payoffs are alternatively associated with a coded ticket (from a ticket printer 52), a portable storage medium or device (e.g., a card magnetic strip), or are transferred to or transmitted to a designated player account. The payoff amounts distributed by the payoff mechanism 50 are determined by one or more pay tables stored in the system memory 44.

Communications between the controller 42 and both the peripheral components of the gaming terminal 10 and the external system 46 occur through input/output (I/O) circuit 56, which can include any suitable bus technologies, such as an AGTL+ frontside bus and a PCI backside bus. Although the I/O circuit 56 is shown as a single block, it should be appreciated that the I/O circuit 56 alternatively includes a number of different types of I/O circuits. Furthermore, in some embodiments, the components of the gaming terminal 10 can be interconnected according to any suitable interconnection architecture (e.g., directly connected, hypercube, etc.).

The I/O circuit 56 is connected to an external system interface or communication device 58, which is connected to the external system 46. The controller 42 communicates with the external system 46 via the external system interface 58 and a communication path (e.g., serial, parallel, IR, RC, 10bT, near field, etc.). The external system 46 includes, in various aspects, a gaming network, other gaming terminals, a gaming server, a remote controller, communications hardware, or a variety of other interfaced systems or components, in any combination. In yet other aspects, the external system 46 may comprise a player's portable electronic device (e.g., cellular phone, electronic wallet, etc.) and the external system interface 58 is configured to facilitate wireless communication and data transfer between the portable electronic device and the controller 42, such as by a near field communication path operating via magnetic field induction or a frequency-hopping spread spectrum RF signals (e.g., Bluetooth, etc.).

The gaming terminal 10 optionally communicates with external system 46 (in a wired or wireless manner) such that each terminal operates as a "thin client" having relatively less functionality, a "thick client" having relatively more functionality, or with any range of functionality therebetween (e.g., an "intermediate client"). In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external systems 46 ("thin client" gaming terminal), or are distributed therebetween in any suitable manner ("intermediate client" gaming terminal).

Figure 3:
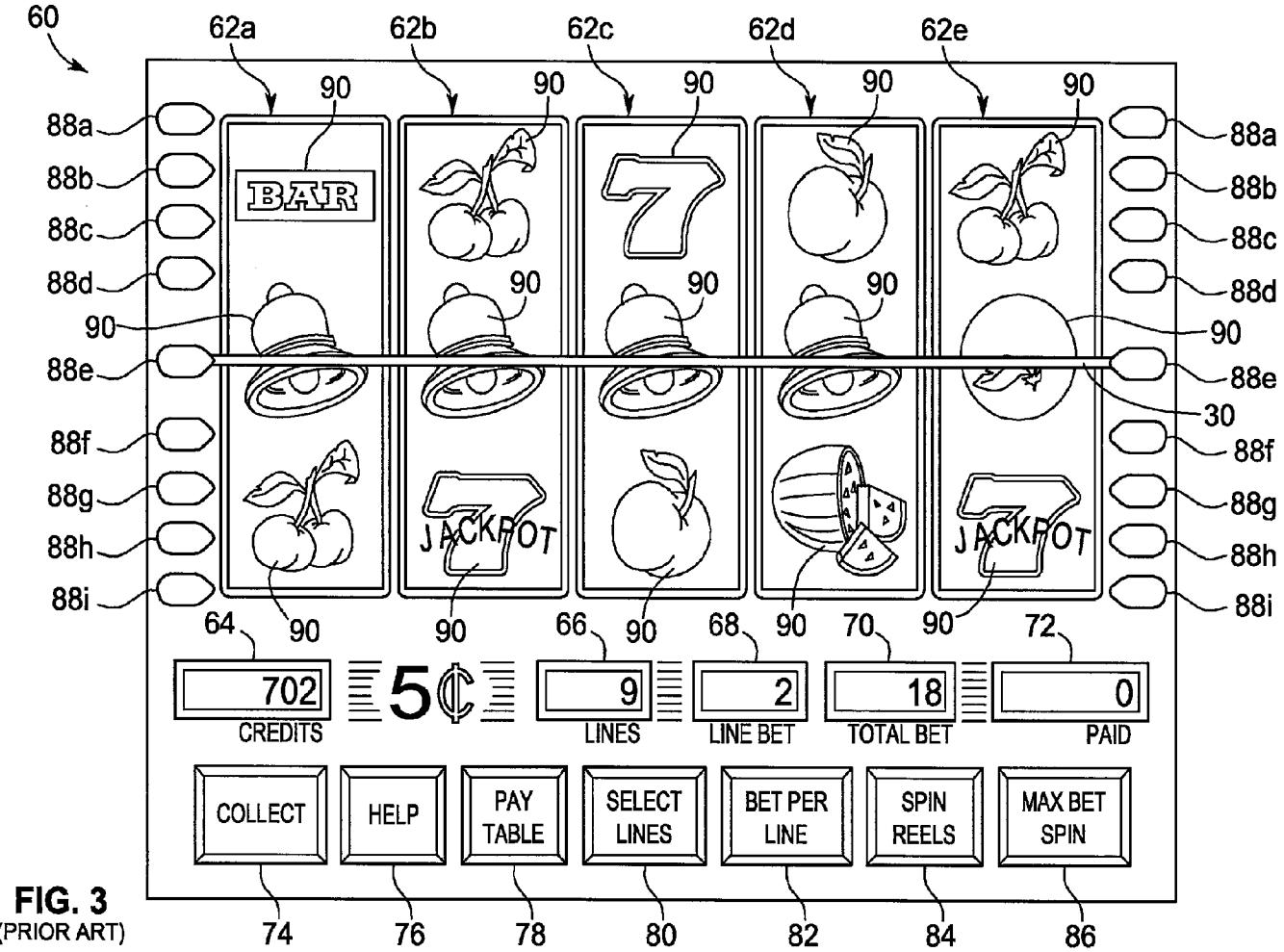
FIG. 3 (PRIOR ART)
FIG. 3 is an image of an exemplary basic-game screen of a wagering game displayed on a gaming terminal.

Referring now to FIG. 3, an image of a basic-game screen 60 adapted to be displayed on the primary display area 14 is illustrated. A player begins play of a basic wagering game by providing a wager. A player can operate or interact with the wagering game using the one or more player-input devices 26. The controller 42, the external system 46, or both, in alternative embodiments, operate(s) to execute a wagering game program causing the primary display area 14 to display the wagering game that includes a plurality of visual elements.

In accord with various methods of conducting a wagering game on a gaming system in accord with the present concepts, the wagering game includes a game sequence in which a player makes a wager, such as through the money/credit detector 48, touch screen 38 soft key, button panel, or the like, and a wagering game outcome is associated with the wager. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 14) through the display of information such as, but not limited to, text, graphics, text and graphics, static images, moving images, etc., or any combination thereof. In accord with the method of conducting the wagering game, the controller 42, which comprises one or more processors, transforms a physical player input, such as a player's pressing of a "Spin Reels" soft key 84 (see FIG. 3), into an electronic data signal indicative of an instruction relating to the wagering game (e.g., an electronic data signal bearing data on a wager amount).

In the aforementioned method, for each data signal, the controller 42 is configured to processes the electronic data signal, to interpret the data signal (e.g., data signals corresponding to a wager input), and to cause further actions associated with the interpretation of the signal in accord with computer instructions relating to such further actions executed by the controller. As one example, the controller 42 causes the recording of a digital representation of the wager in one or more storage devices (e.g., system memory 44 or a memory associated with an external system 46), the controller, in accord with associated computer instructions, causing the changing of a state of the data storage device from a first state to a second state. This change in state is, for example, effected by changing a magnetization pattern on a magnetically coated surface of a magnetic storage device or changing a magnetic state of a ferromagnetic surface of a magneto-optical disc storage device, a change in state of transistors or capacitors in a volatile or a non-volatile semiconductor memory (e.g., DRAM), etc.). The noted second state of the data storage device comprises storage in the storage device of data representing the electronic data signal from the controller (e.g., the wager in the present example). As another example, the controller 42 further, in accord with the execution of the instructions relating to the wagering game, causes the primary display 14 or other display device and/or other output device (e.g., speakers, lights, communication device, etc.), to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by the RNG) that is used by the controller 42 to determine the outcome of the game sequence, using a game logic for determining the outcome based on the randomly generated number. In at least some aspects, the controller 42 is configured to determine an outcome of the game sequence at least partially in response to the random parameter.

The basic-game screen 60 is displayed on the primary display area 14 or a portion thereof. In FIG. 3, the basic-game screen 60 portrays a plurality of simulated movable reels 62*a-e*. Alternatively or additionally, the basic-game screen 60 portrays a plurality of mechanical reels or other video or mechanical presentation consistent with the game format and theme. The basic-game screen 60 also advantageously displays one or more game-session meters and various buttons adapted to be actuated by a player.

In the illustrated embodiment of FIG. 3, the game-session meters include a "credit" meter 64 for displaying a number of credits available for play on the terminal; a "lines" meter 66 for displaying a number of paylines to be played by a player on the terminal; a "line bet" meter 68 for displaying a number of credits wagered (e.g., from 1 to 5 or more credits) for each of the number of paylines played; a "total bet" meter 70 for displaying a total number of credits wagered for the particular round of wagering; and a "paid" meter 72 for displaying an amount to be awarded based on the results of the particular round's wager. The depicted user-selectable buttons include a "collect" button 74 to collect the credits remaining in the credits meter 64; a "help" button 76 for viewing instructions on how to play the wagering game; a "pay table" button 78 for viewing a pay table associated with the basic wagering game; a "select lines" button 80 for changing the number of paylines (displayed in the lines meter 66) a player wishes to play; a "bet per line" button 82 for changing the amount of the wager which is displayed in the line-bet meter 68; a "spin reels" button 84 for moving the reels 62*a-e*; and a "max bet spin" button 86 for wagering a maximum number of credits and moving the reels 62*a-e* of the basic wagering game. While the gaming terminal 10 allows for these types of player inputs, the present invention does not require them and can be used on gaming terminals having more, less, or different player inputs.

As shown in the example of FIG. 3, paylines 30 extend from one of the payline indicators 88*a-i* on the left side of the basic-game screen 60 to a corresponding one of the payline indicators 88*a-i* on the right side of the screen 60. A plurality of symbols 90 is displayed on the plurality of reels 62*a-e* to indicate possible outcomes of the basic wagering game. A winning combination occurs when the displayed symbols 90 correspond to one of the winning symbol combinations listed in a pay table stored in the memory 44 of the terminal 10 or in the external system 46. The symbols 90 may include any appropriate graphical representation or animation, and may further include a "blank" symbol.

Symbol combinations are evaluated in accord with various schemes such as, but not limited to, "line pays" or "scatter pays." Line pays are evaluated left to right, right to left, top to bottom, bottom to top, or any combination thereof by evaluating the number, type, or order of symbols 90 appearing along an activated payline 30. Scatter pays are evaluated without regard to position or paylines and only require that such combination appears anywhere on the reels 62*a-e*. While an embodiment with nine paylines is shown, a wagering game with no paylines, a single payline, or any plurality of paylines will also work with the present invention. Additionally, though an embodiment with five reels is shown in FIG. 3, different embodiments of the gaming terminal 10 comprise a greater or lesser number of reels in accordance with the present invention.

Figure 4:
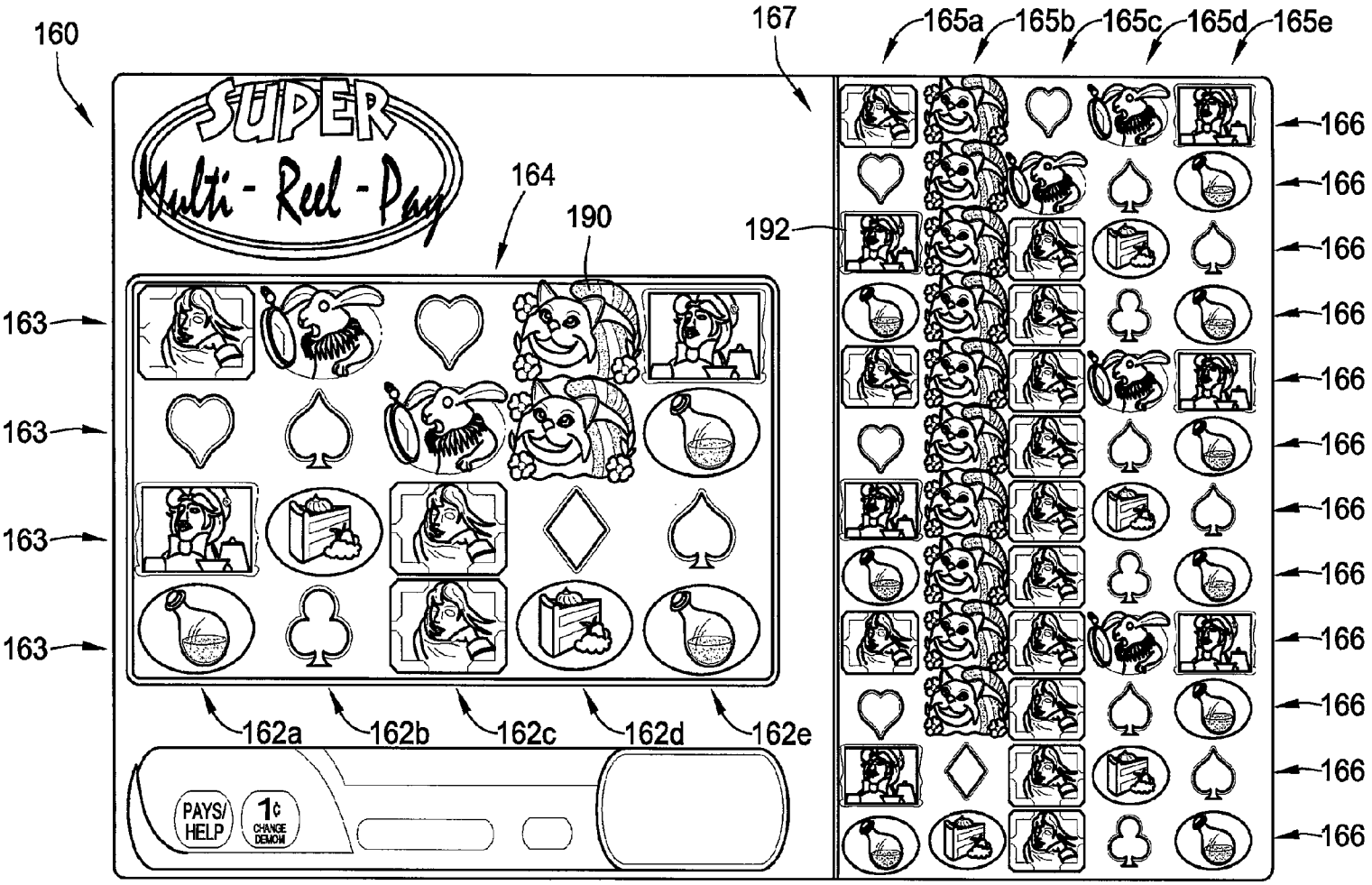
FIGS. 4-19 are images of exemplary game screens according to aspects of the present invention.

FIG. 4 illustrates an image of a game screen 160 that is adapted to be displayed on a display area of the gaming terminal 10. In response to a wager and inputs from a player via player-input devices 26, the controller 42 and/or the external system 46 operate to execute a wagering game program that displays the game screen 160.

As shown in FIG. 4, the game screen 160 presents multiple reels that arrange symbols into multiple arrays. In particular, the game screen 160 presents a first set of simulated movable reels 162*a-e* and a second set of simulated movable reels 165*a-e*. The reels 162*a-e* include symbols 190 and the reels 165*a-e* include symbols 192. The symbols 190 and 192 are consistent with a specific game theme, such as the theme shown in FIG. 4 based on the story of Alice in Wonderland. The game screen 160 presents four vertically-arranged symbol positions 163 for each of the first set of five reels 162*a-e*. Meanwhile, the game screen 160 presents twelve vertically-arranged symbol positions 166 for each of the second set of five reels 165*a-e*. Correspondingly, the first set of reels 162*a-e* presents the symbols 190 according to a first array 164 having five columns and four rows, i.e., a 5×4 configuration. The second set of reels 165*a-e* presents the symbols 192 according to a second array 167 having five columns and twelve rows, i.e., a 5×12 configuration. The second array 167 has a greater number of rows than the first array 164. Although the first array 164 and second array 167 are described with these particular configurations, it is understood that alternative embodiments may employ array configurations with different numbers of columns and rows. In these alternative embodiments, the configurations may be randomly determined or may depend on the wager placed by the player.

Each of the reels 162*a-e* is associated with a particular sequence of symbols 190, and each of the reels 164*a-e* is associated with a particular sequence of symbols 192. In some embodiments, the sequence of symbols 190 is the same as the sequence of symbols 192. In other embodiments, the sequence of symbols 190 is different from the sequence of symbols 192. Because four symbols 190 are shown for each of the reels 162*a-e* and twelve symbols 192 are shown for each of the reels 165*a-e*, the sequence of symbols 192 for the reels 165*a-e* may be longer than the sequence of symbols 190 for the reels 162*a-e*. In general, each of the reels 162*a-e* and 165*a-e* is associated with one of any number of different sequences of symbols.

Figure 5:
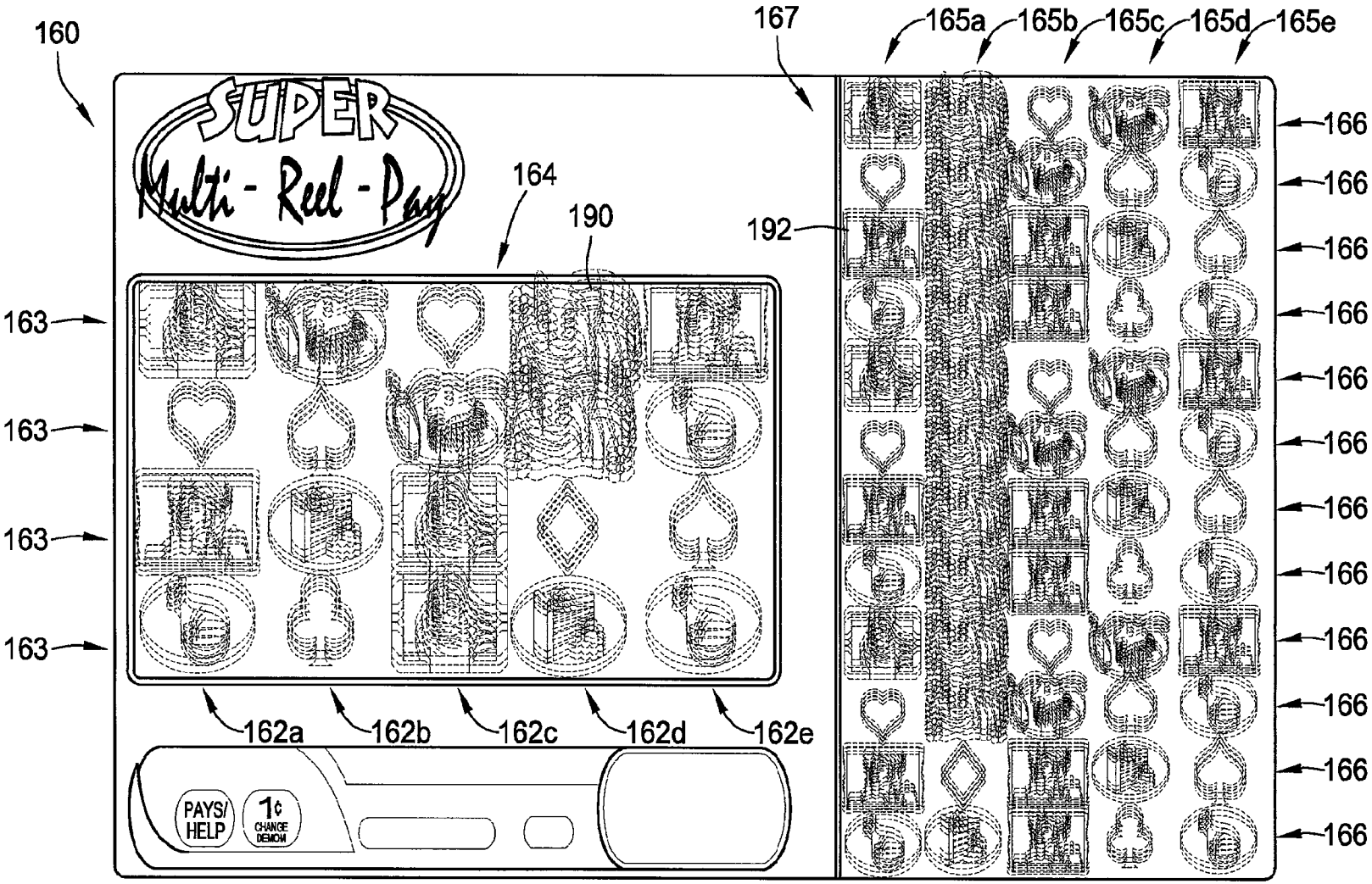

As shown in FIG. 5, when the player initiates a wagering game, the reels 162*a-e* and 165*a-e* rotate according to their associated sequence of symbols. The reels 162*a-e* and 165*a-e* resemble the mechanically rotating reels of a conventional slot machine. Specifically, the game screen 160 shows the symbols 190 passing in sequence through the four symbol positions 163 for each of the reels 162*a-e*. Additionally, the game screen 160 shows the symbols 192 passing in sequence through the twelve symbol positions 166 for each of the reels 165*a-e*.

Figure 6:
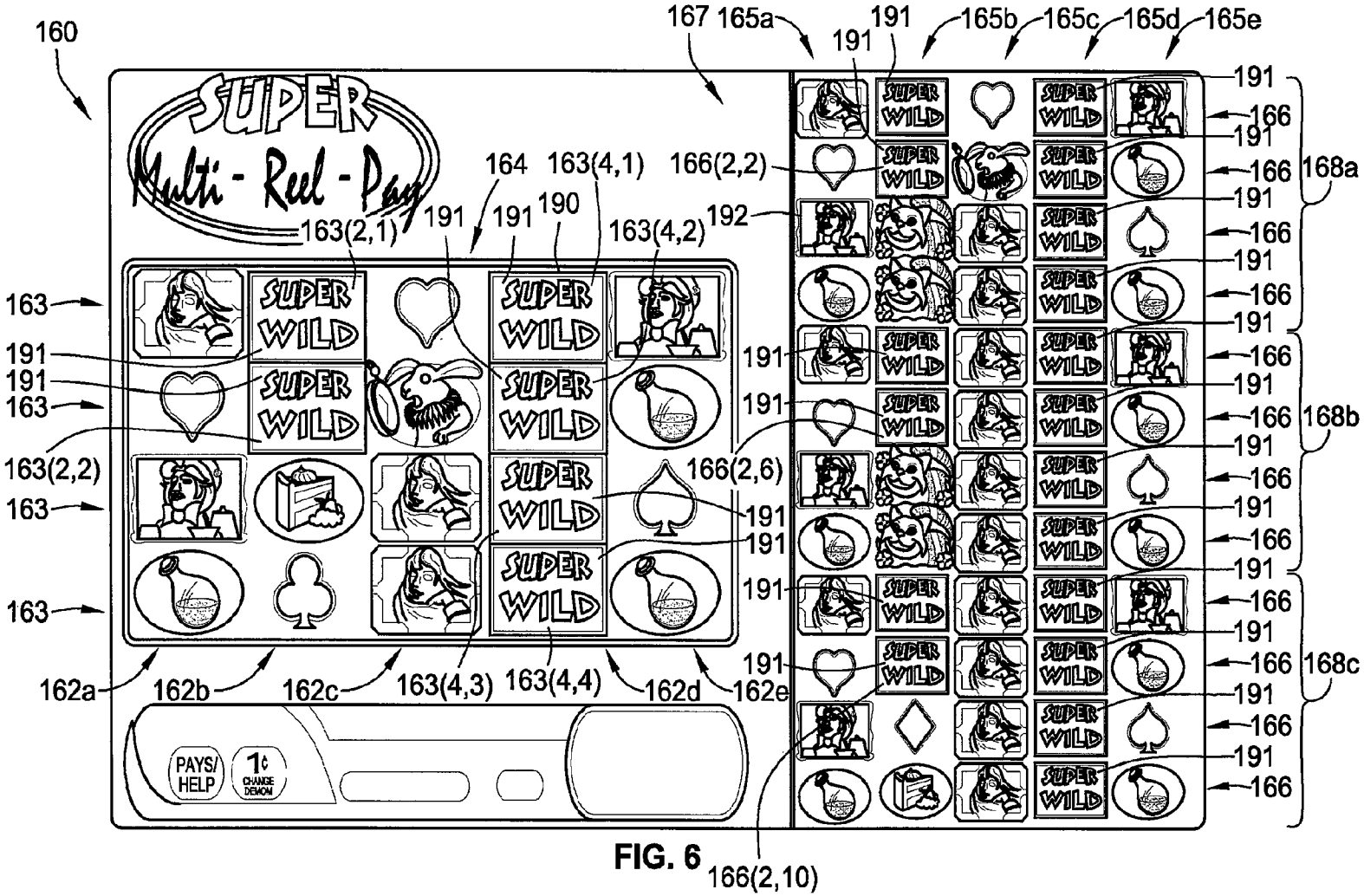

As illustrated in FIG. 6, the reels 162*a-e* and 165*a-e* eventually stop rotating in the game screen 160. Each of the reels 162*a-e* reveals four successive symbols 190 randomly selected from the associated sequence of symbols 190. Each of the reels 165*a-e* reveals twelve successive symbols 192 randomly selected from the associated sequence of symbols 192. The reels 162*a-e* and 164*a-e* may rotate at different random rates and/or stop at different random times so that a variety of symbol combinations are presented. Accordingly, the first array 164 and the second array 167 present a randomly selected combination of symbols 190.

According to aspects of the present invention, selected symbols 191 appearing in the first array 164 are copied to one or more symbol positions 166 in the second array 167. In effect, some symbols 192 initially appearing in the second array 167 are replaced by the selected symbols 191 appearing in the first array 164. In some embodiments, a symbol 191 in the first array 164 is selected and copied if it is a particular type of symbol. For example, FIG. 6 shows that the symbols 191 are selected if they are "Super Wild" symbols. The "Super Wild" symbols appear in the positions 163(column 2, row 1), 163(2,2), 163(4,1), 163(4,2), 163(4,3), and 163(4,4) in the first array 164. In this example, the "Super Wild" symbols appearing in the first array 164 are copied to corresponding symbol positions 166 in the second array 167. Likewise, other aspects of the present concepts contemplate a reverse mapping from one or more of the sub-arrays 168*a-c*, discussed below, to the first array 164.

As shown further in FIG. 6, the second array 167 is divided into three separate sub-arrays 168*a-c* having five columns and four rows, i.e., a 5×4 configuration. Because each of the sub-arrays 168*a-c* has a 5×4 configuration, there is a one-to-one mapping between each symbol position 163 in the first array 164 and a position 166 in each of the sub-arrays 168*a-c*. For example, the symbol position 163(2,2) in the first array 164 is mapped to the symbol positions 166(2,2), 166(2,6), and 166(2,10) in sub-arrays 168*a-c* in the second array 167. Therefore, the "Super Wild" symbol appearing in position 163(2,2) in the first array 164 is copied to positions 166(2,2), 166(2,6), and 166(2,10) in the second array 167. The other "Super Wild" symbols appearing in positions 163(2,2), 163(4,1), 163(4,2), 163(4,3), and 163(4,4) are copied to corresponding positions 166 in the second array 167 in a similar manner. Although three sub-arrays 168*a-c* are shown, the present concepts include a greater of lesser number of sub-arrays (e.g., two sub-arrays, four sub-arrays, etc.). In some embodiments, the player may be required to place additional wagers to put each of the sub-arrays 168*a-c* into play.

Combinations of symbols 190 across the first array 164 and/or combinations of symbols 192 across the second array 167 are evaluated to determine the outcome of the wagering game. As discussed previously, for example, combinations of symbols may be evaluated according to various schemes such as, but not limited to, line pays or scatter pays. A winning combination occurs when the symbols displayed according to line pays, scatter pays, etc., correspond to one of the winning symbol combinations listed in a pay table stored in the memory 44 of the terminal 10 or in the external system 46.

In general, the evaluation of symbol combinations in each sub-array 168*a-c* is independent of the other sub-arrays. However, the sub-arrays 168*a-c* are not independent of each other as the reels 165*a-e* and their associated sequence of symbols extend into or through the sub-arrays 168*a-c*.

The multiple arrays enable a greater variety of methods for presenting different symbol combinations to determine the outcome of the wagering game. For example, the player may place wagers on selected paylines in the first array 164 and the sub-arrays 169*a-c*. In one embodiment, the player may be required to select each payline in the first array 164 and the sub-arrays 168*a-c*, where an additional wager is required for each selected payline.

Figure 7:
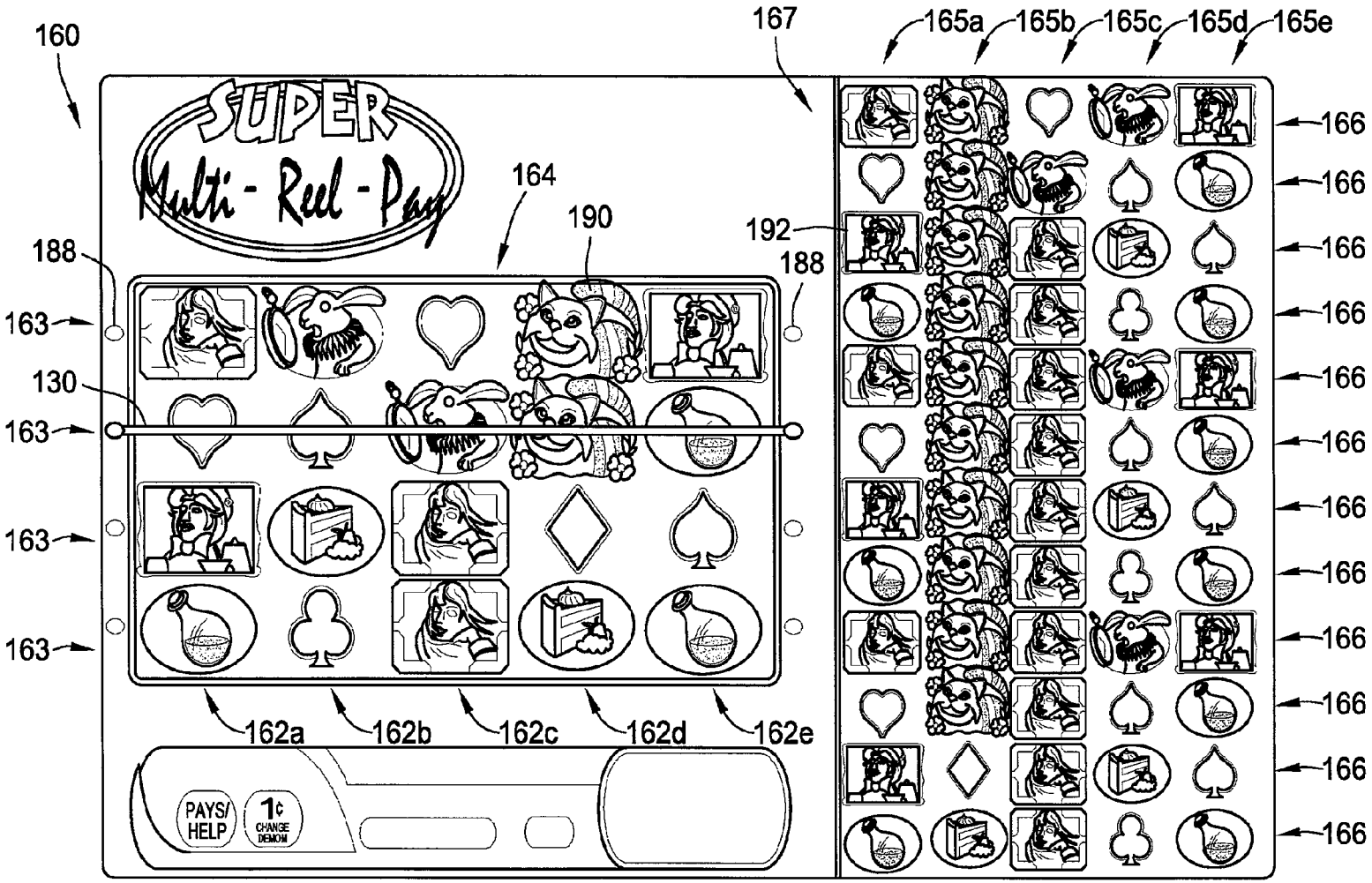

In another embodiment, the player selects paylines in the first array 164 and combinations of symbols are evaluated for the selected paylines in the first array 164 as well as corresponding paylines mapped to one or more of the sub-arrays 168*a-c*. As shown in FIG. 7, the first array 164 is associated with payline indicators 188. The player can select one or more paylines 130, which extend from one of the payline indicators 188 on the left side of the first array 164 to a corresponding one of the payline indicators 188 on the right side of the first array 164.

Figure 8:
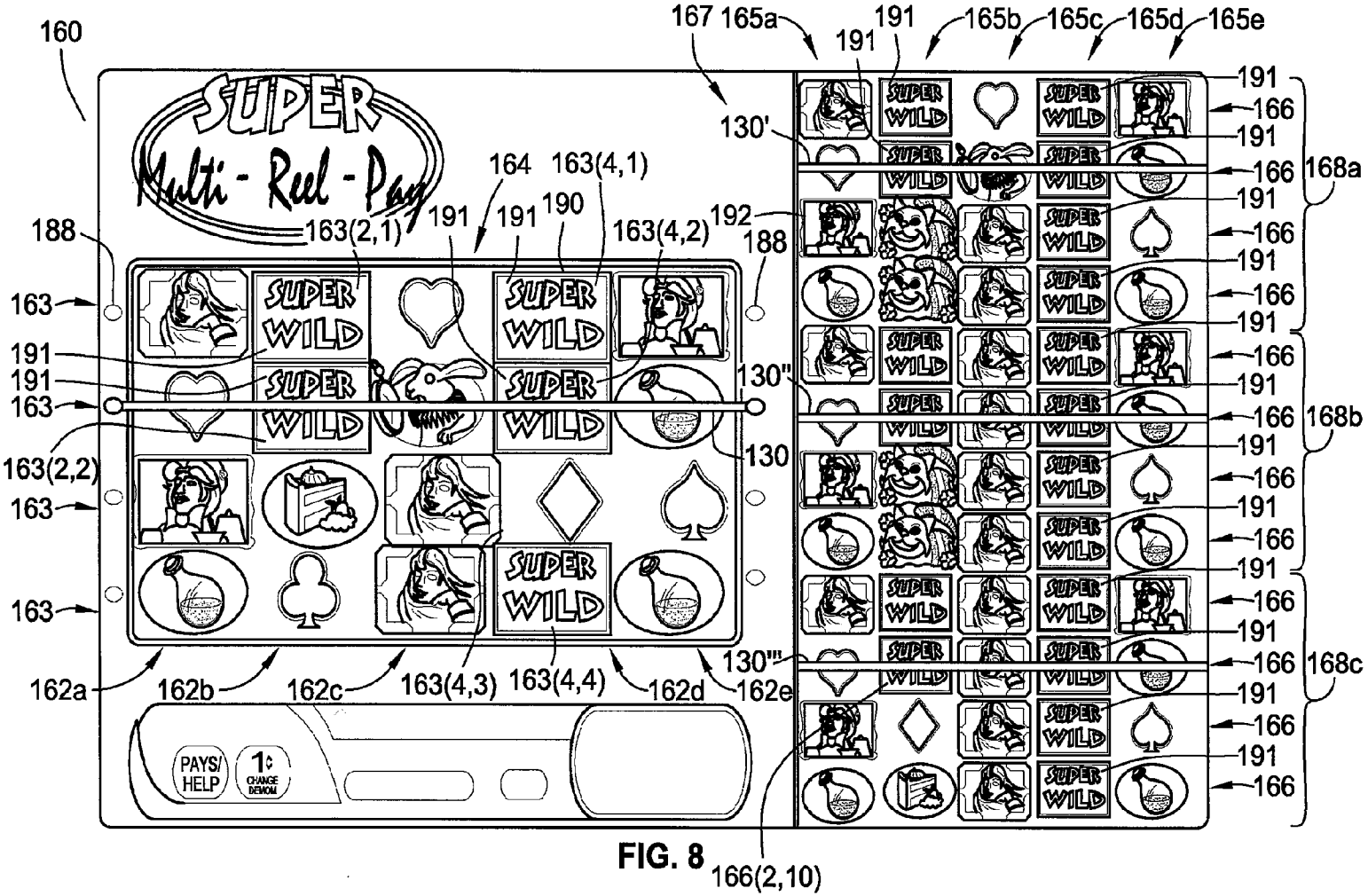

By way of example, FIG. 7 shows that the player has selected a payline 130 that corresponds to the second row of the first array 164, i.e., positions 163(1,2), 163(2,2), 163(3,2), 163(4,2), and 163(5,2). When the reels 162*a-e* and 165*a-e* stop spinning and the "Super Wild" symbols are copied from the first array 164 to the second array 167, the wagering game evaluates the combination of symbols along the selected payline 130 of the first array 164 to determine whether it is a winning combination. In addition, based on the selection of the payline 130 in the first array 164, corresponding paylines 130', 130", and 130'" are automatically established in each of the sub-arrays 168*a-c*, respectively. As shown in FIG. 8, based on the selection of the second row of the first array 164 as the payline 130, the second row of each of the sub-arrays 168*a-c* are established as paylines 130', 130", and 130'". In sum, paylines selected in the first array 164 are correspondingly mirrored in the second array 167, and these mirrored paylines are also evaluated for winning combinations.

In some embodiments, the player may be required to place additional wagers to put each of the sub-arrays 168*a-c* into play. For example, the player may place a wager to evaluate sub-array 168*b* for winning combinations. In this case, only the payline 130" in addition to payline 130 are evaluated.

It is to be understood that the payline indicators 188 and payline 130 shown in FIG. 7 are only provided as examples. Any configuration of payline indicators 188 and paylines 130 may be available to permit the player to select one or more combinations/patterns of symbol positions that are used to determine the outcome of the wagering game.

In the examples illustrated in FIGS. 4-8, each "Super Wild" symbol is a wild symbol that acts as any one of the possible symbols 190 and/or 192. In particular, each "Super Wild" symbol acts as the symbol that is most advantageous when combined with a set of given symbols. Therefore, it is more advantageous to the user when more "Super Wild" symbols appear in the paylines. Accordingly, copying "Super Wild" symbols to additional positions in the sub-arrays 168*a-c* increases the number of "Super Wild" symbols potentially in play.

As shown in FIG. 6, a plurality of "Super Wild" symbols may appear in succession, or clumps, in the sequence of symbols 190 rotated through the reels 162*a-c*. For example, the "Super Wild" symbols at positions 163(4,1), 163(4,2), 163(4,3), and 163(4,4) may be a part of a clump of "Super Wild" symbols for reel 164*d*. Such clumps of "Super Wild" symbols increase the number of "Super Wild" symbols that may appear in the array 167 and sub-arrays 168*a-c* at the same time.

Other approaches can be employed to increase the number of "Super Wild" symbols. For example, if a symbol known as a "Mega Wild" symbol appears in the first array 164, the "Mega Wild" symbol distributes a plurality of additional "Super Wild" symbols to randomly selected positions 163 in the first array 164. The number of additional "Super Wild" symbols may be predetermined, randomly determined, or determined with an aspect of game play, such as the wager level or the number of selected paylines. These additional "Super Wild" symbols distributed by the "Mega Wild" symbol are also copied from the positions 163 in the first array 164 to corresponding positions 166 in the second array 167 according to a one-to-one mapping between the first array 164 and the sub-arrays 168*a-c*. In some embodiments, an enhanced probability of realizing "Mega Wilds" may be purchased with an additional wager.

Figure 9:
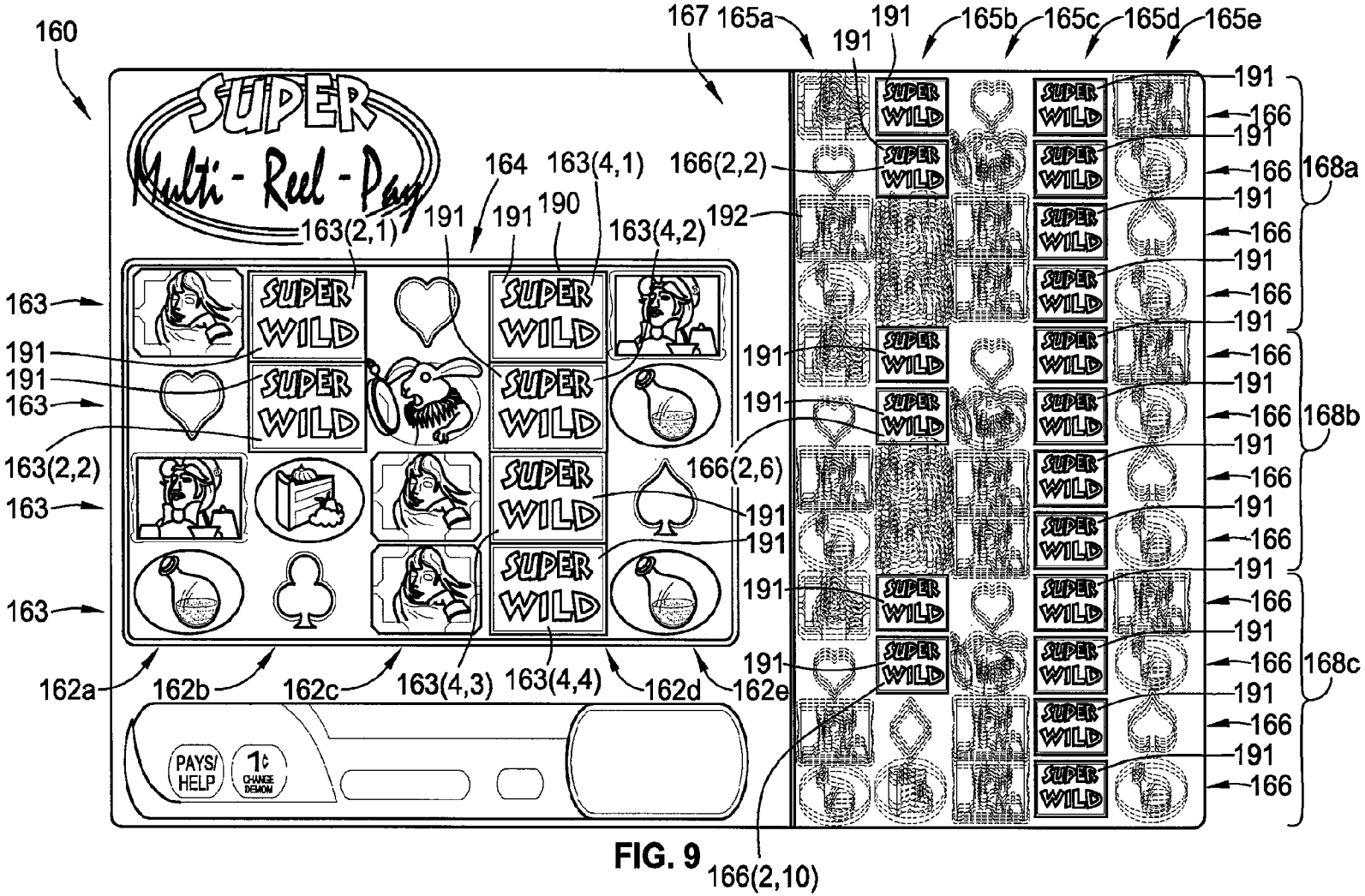

In the embodiments of FIGS. 4-8, when the player begins play of the wagering game, the player triggers the simultaneous rotation of the reels 162*a-e* and 165*a-e*. Once the reels 162*a-e* and 165*a-e* stop, the selected symbols 191, e.g., "Super Wild" symbols, are then copied from the first array 164 to the sub-arrays 168*a-c* and the resulting combinations are evaluated. To provide visual entertainment and enhance the player's excitement, animation or other visual effects may be employed to highlight that selected symbols 191 are being copied to the sub-arrays 168*a-c*. In an alternative embodiment, when the player begins play of the wagering game, the reels 162*a-e* rotate while the reels 165*a-e* remain stationary. When the reels 162*a-e* stop, the selected symbols 191, e.g., "Super Wild" symbols, from the first array 164 are copied to corresponding positions in the sub-arrays 168*a-c*. As shown in FIG. 9, the copied symbols 191 are fixed in their positions 166 while the reels 165*a-e* rotate symbols through the other positions 166 in the second array 167. The copied symbols 191 become a part of the combination of symbols 192 in the second array 167. Once the reels 165*a-e* stop rotating, the resulting combinations of symbols across the reels 162*a-e* and 165*a-e* are evaluated to determine the outcome of the wagering game.

In the examples above, the symbols 191 are copied from the first array 164 to the second array 167 according to a one-to-one mapping between the first array 164 and the sub-arrays 168*a-c*. However, it is understood that a symbol 191 in the first array 164 may be selected and copied to one or more positions in the second array 167 without requiring a one-to-one mapping. For example, a selected symbol 191 in the first array 164 may be copied to one or more random positions 166 in each of the sub-arrays 168*a-c*.

Figure 10:
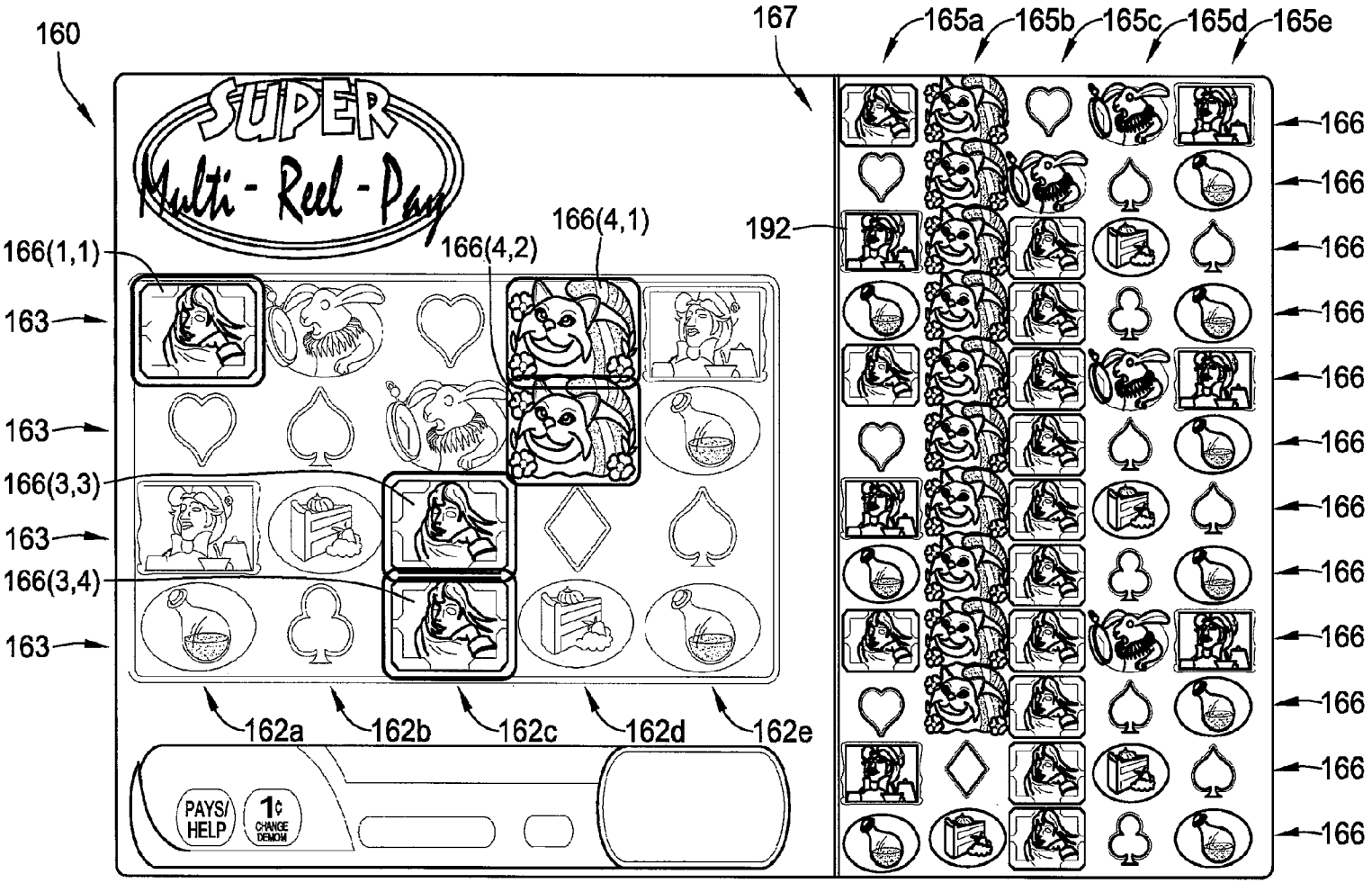

Moreover, in the examples illustrated in FIGS. 4-9, the symbols 191 are copied from the first array 164 to the second array 167 if they are a particular type of symbol, i.e., if they are "Super Wild" symbols. In other embodiments, however, the symbols 191 are copied from the first array 164 to the second array 167 if they appear in particular positions in the first array 164. For example, the player may interactively select, via player-input devices 26, a number of positions in the array 164. Alternatively, the controller 42 may randomly select a number of positions in the array 164. After the reels 162*a-e* are rotated, the symbols that randomly appear in the positions selected by the player or controller are copied to the corresponding positions in the sub-arrays 168*a-c*. As shown in FIG. 10, the player or controller 142 selects five positions 166(1,1), 166(3,3), 166(3,4), 166(4,1), and 166(4,2). Each of the five selected positions are highlighted by a bright rectangle or other graphical feature. When the reels 164*a-e* stop rotating, the randomly selected symbols in 166(1,1), 166(3,3), 166(3,4), 166(4,1), and 166(4,2) are copied to the corresponding sub-arrays 168*a-c* according to the one-to-one mapping. Of course, embodiments are not limited to selecting five positions in the array 164. In some cases, the number of positions selected by the player or controller 42 may be randomly determined or depend on the wager placed by the player.

Moreover, some embodiments only copy the symbols if they appear in the selected positions and if the symbols are a particular type of symbol. For example, the controller 42 only copies the symbols in the selected positions if they are also "Super Wild" symbols. In this example, a greater wager allows the selection of more positions to increase the chances that a "Super Wild" symbol will appear in a selected position and be advantageously copied to the sub-arrays 168*a-c*.

It is noted that if the symbols appearing in the selected positions are copied to the second array 167 without regard to the symbol type, there is a risk that the copied symbol will produce a disadvantageous result. In other words, an otherwise winning combination of symbols in the second array 167 may be converted into a non-winning combination when one of the symbols is replaced by a symbol from the first array 164. Therefore, such a disadvantageous result is prevented if the copied symbols are always some type of wild symbol.

Alternatively, in some embodiments, the controller 42 only copies a symbol into the second array 167 if the copying produces an advantageous result. In other embodiments, the player may be required to employ some skill and decide whether or not a symbol is copied to the second array 167.

As described above, a selected symbol 191, such as a wild symbol, may be copied from the first array 164 to a given position in only one of the sub-arrays. In some cases, this selected symbol 191 may not provide any benefit to the symbols in the one array, i.e., the combination of symbols along the paylines in that sub-array are not improved. However, in some cases, the combination of symbols along the paylines in the one of the other sub-arrays would be improved if the selected symbol 191 were copied to that other sub-array instead. Accordingly, in some embodiments, the player may be permitted to swap the sub-arrays 168*a-c* to achieve more advantageous symbol combinations with the symbols copied from the first array 164. For example, if a "Super Wild" in a particular position in the second array 167 does not provide a winning combination with the symbols of sub-array 168*b*, the player may be permitted to move sub-array 168*c* into the initial position of the sub-array 168*b* to benefit from the "Super Wild" symbol. To enable this feature, an additional wager may be required before the reels are triggered.

Figure 11:
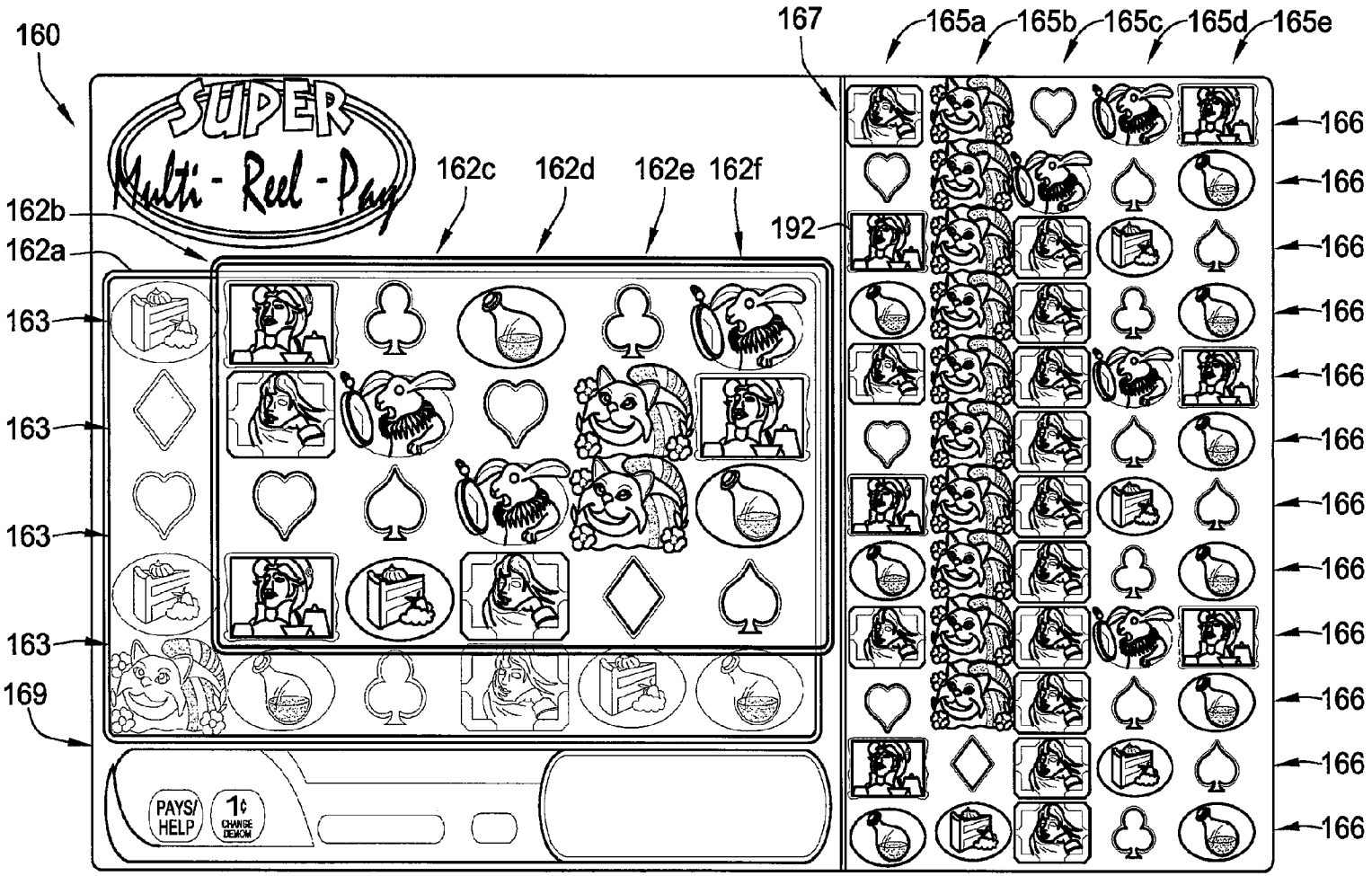

According to an alternative embodiment, FIG. 11 shows that the first array 164 is selected from a larger array 169. In other words, the symbols 190 in the first array 164 are a subset of the symbols 190 in the larger array 169. The first array 164 is highlighted by a bright rectangle or other graphical feature. In FIG. 11, the larger array 169 includes 6 columns and 5 rows, i.e., a 6×5 configuration. The five columns and four rows of the first array 164 are selected from the six columns and five rows of the larger array 169, respectively. In other embodiments, the larger array 169 may have any number of columns and rows as long as the first array 164 can be selected from the larger array 169. The player may interactively select, via player-input devices 26, the first array 164 from the larger array 169. Alternatively, the controller 42 may randomly select the first array 164 from the larger array 169. The size of the first array 164 may also be selected by the player or the controller 42 and may depend on the wager placed by the player. In operation, a player-input device 26 may allow the player to select a position in an array and drag a pointer to make a box that defines the first array 164.

As shown in FIG. 11, four of the symbols 190 in each of the five reels 162*b-f* are included in the first array 164. In operation, however, all six reels 162*a-f* rotate successive symbols 190 through all five rows. The player is able to see whether the position of the first array 164 in the larger array 169 was more advantageous than the other possible positions. Once the six reels 162*a-f* have stopped rotating, the first array 164 is processed and evaluated as described above.

Figure 12:
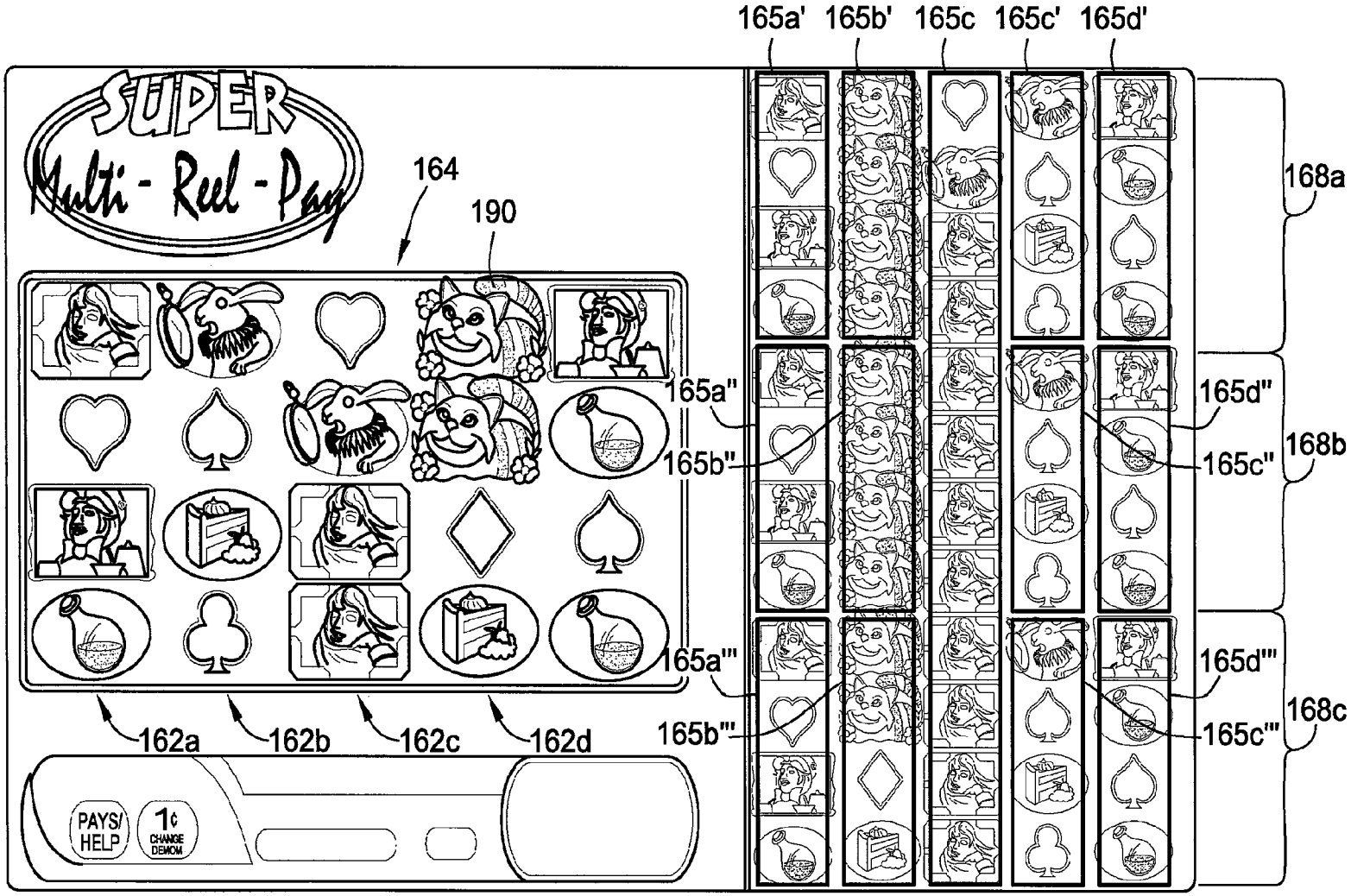

Referring to FIG. 12, it is to be understood that all reels do not have to extend through the entire second array 167 as shown in the previous embodiments. In particular, FIG. 12 shows that only the reel 165*c* extends through the entire second array 167. The sub-arrays 168*a-c* share a common reel, but each of the sub-arrays 168*a-c* has a set of four other reels that are independent of the other sub-arrays 168*a-c*. The sub-array 168*a* includes reels 165*a*', b', d', e' which are independent of the sub-arrays 168*b, c*. The sub-array 168*b* includes reels 165*a*", b", d", e" which are independent of the sub-arrays 168*a, c*. The sub-array 168*c* includes reels 165*a*'", b'", d", e'" which are independent of the sub-arrays 168*a, b*. Other combinations of shared and independent reels for sub-arrays are contemplated according to embodiments of the present invention. By way of example, one or more of the symbol positions 166 (e.g., all symbol positions) may comprise a separate reel.

Figure 13:
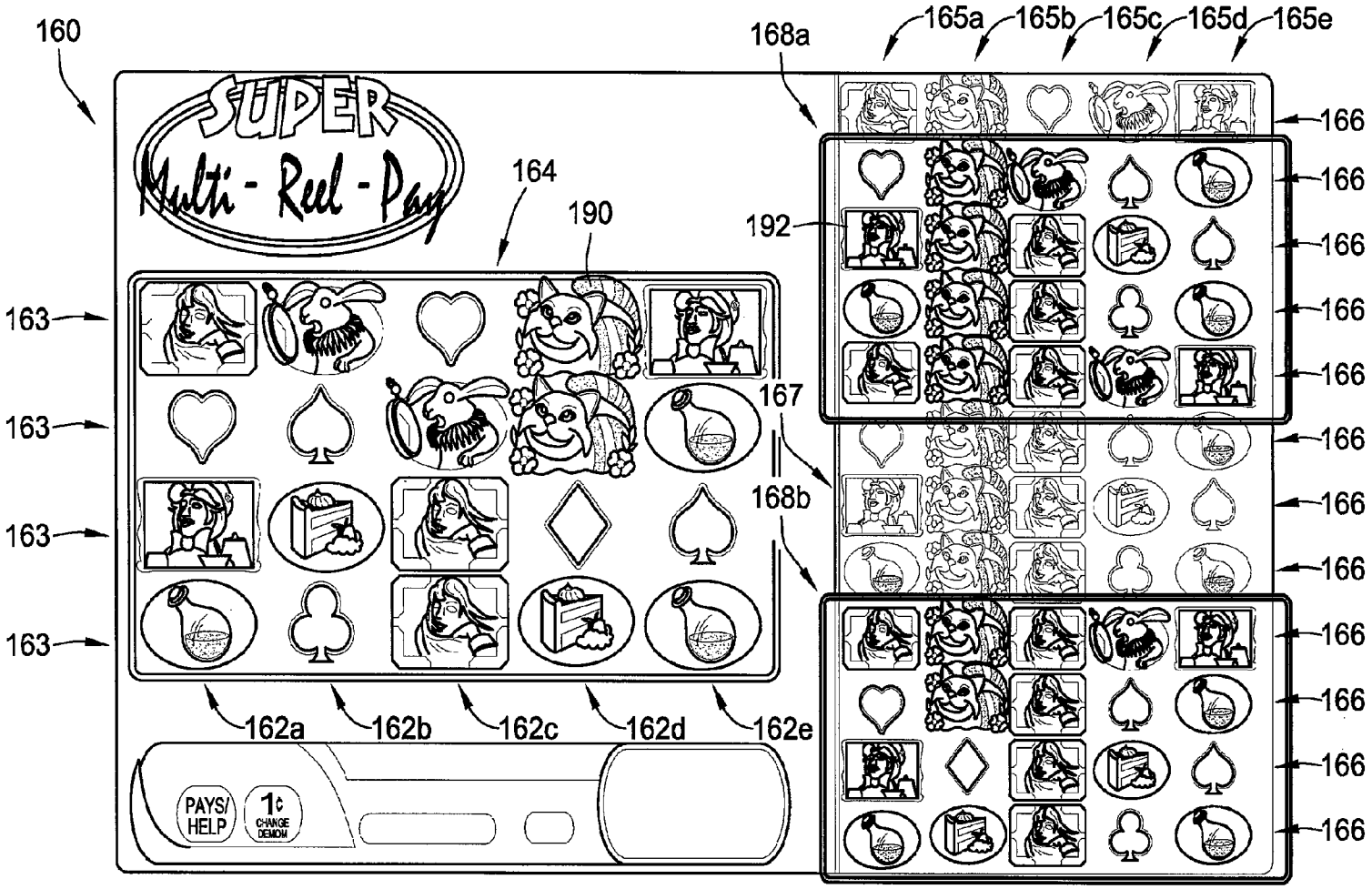

Because the second array 167 described above has a 5×12 configuration, the second array 167 can be divided evenly into the three sub-arrays 168*a-c*, which have a 5×4 configuration. However, as shown in FIG. 13, the second array 167 does not have to be divided evenly into three sub-arrays 168*a-c*. Rather, two non-overlapping sub-arrays 168*a, b* can be selected from different sections of the second array 167. In FIG. 13, the second through fifth rows of the second array 167 are selected to define the first sub-array 168*a*. and the ninth through twelfth rows of the second array 167 are selected to define the second sub-array 168*b*. The two selected sub-arrays 168*a, b* are each highlighted by a bright rectangle or other graphical feature. The player may interactively select, via player-input devices 26, the sub-arrays 168*a,b* from the second array 167. Alternatively, the controller 42 may randomly select the sub-arrays 168*a,b* from the second array 167. Although FIG. 13 illustrates the selection of two 5×4 sub-arrays 138*a, b* from a 5×12 array 167, it is understood that other embodiments may allow any number of sub-arrays of any size to be selected from a second array of a larger size. The selected size(s) in these other embodiments may be randomly determined or depend on the wager placed by the player.

Figure 14:
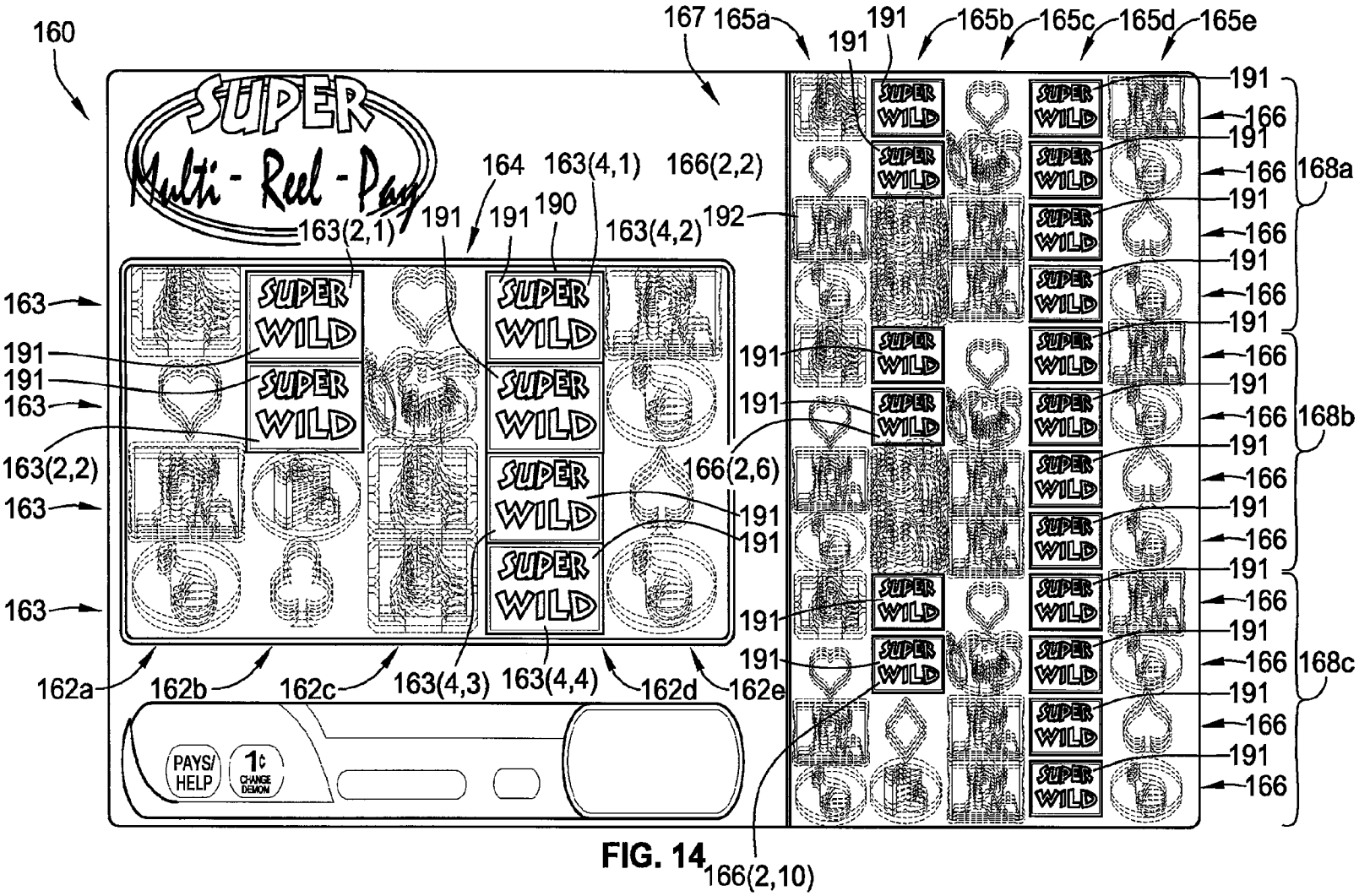

Although embodiments of the game-screen 160 may be employed to provide a basic game for the gaming terminal 10, the game-screen 160 may also be adapted for bonus-game play. For example, during basic game play, selected symbols, such as "Super Wild" symbols, are copied from the first array 164 to the second array 167 as described above. If, for example, a required number of bonus symbols also appear in the first array 164 and/or the second array 164, the player is awarded one or more free bonus spins in reels 162*a-e*, 165*a-e*, and/or other reel set(s). As shown in FIG. 14, when the player redeems the free bonus spins, the reels 162*a-e* and 165*a-e* rotate while the "Super Wild" symbols from the basic game play remain in place. As such, the player can achieve winning symbol combinations with the same "Super Wild" symbols during the free bonus spins. In some embodiments, if additional "Super Wild" symbols appear in the first array 164 during a bonus free spin, they may also be copied to the second array 167 as described above. The increase in "Super Wild" symbols with such free bonus spins improves a player's chance to achieve a winning symbol combination.

Figure 15:
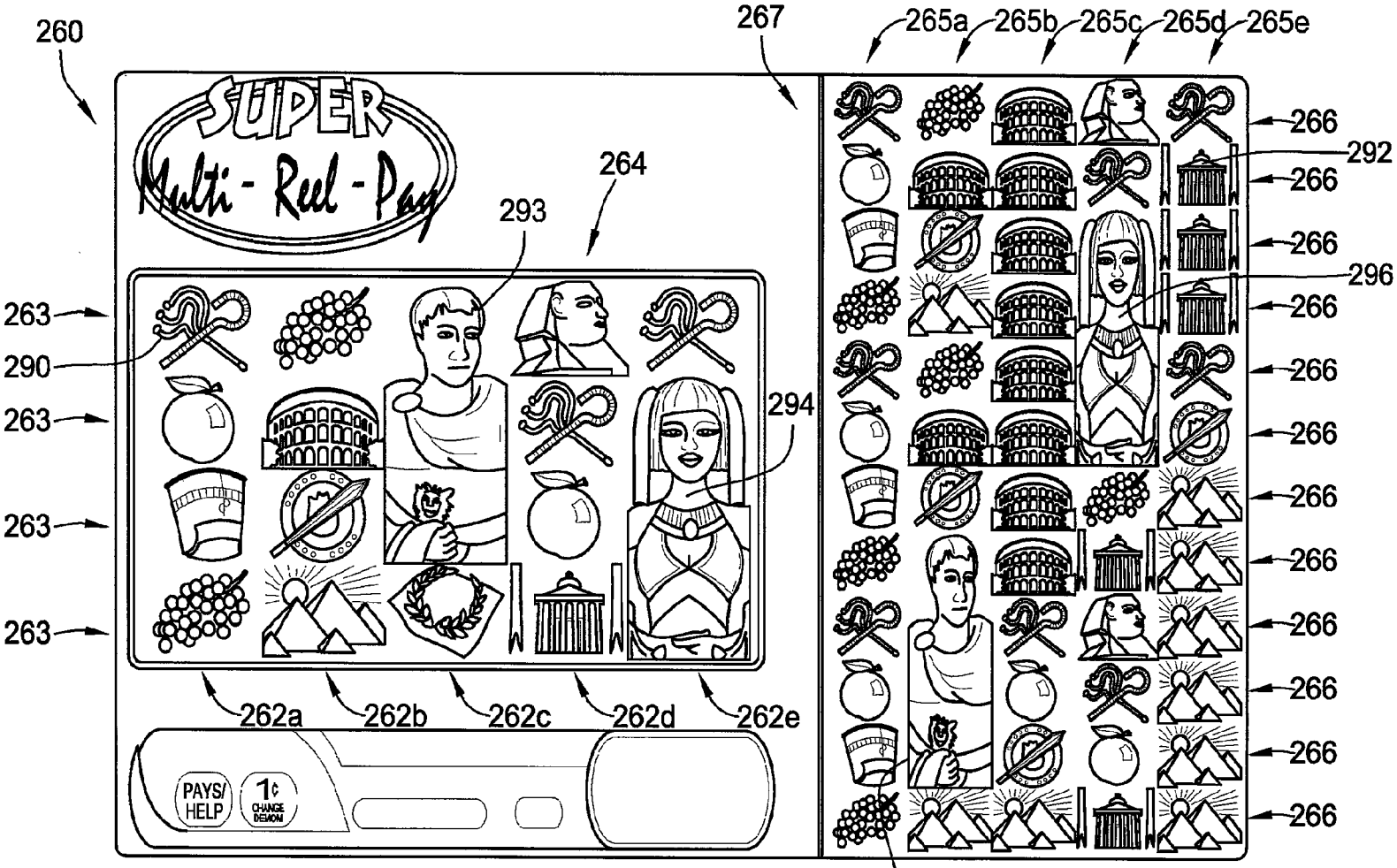

Referring now to FIG. 15, another embodiment of a game screen is illustrated. In response to a wager and inputs from a player via player-input devices 26, the controller 42 and/or the external system 46 operate to execute a wagering game program that displays the game screen 260.

As shown in FIG. 15, the game screen 260 presents multiple reels that arrange symbols into multiple arrays. In particular, the game screen 260 presents a first set of simulated movable reels 262*a-e* and a second set of simulated movable reels 265*a-e*. The reels 262*a-e* include symbols 290 and the reels 265*a-e* include symbols 292. The symbols 290 and 292 are consistent with a specific game theme, such as the theme shown in FIG. 15 based on the story of Cleopatra. The game screen 260 presents four vertically-arranged symbol positions 263 for each of the first set of five reels 262*a-e*. Meanwhile, the game screen 260 presents twelve vertically-arranged symbol positions 266 for each of the second set of five reels 265*a-e*. Correspondingly, the first set of reels 262*a-e* presents the symbols 290 according to a first array 264 having five columns and four rows, i.e., a 5×4 configuration. The second set of reels 265*a-e* presents the symbols 292 according to a second array 267 having five columns and four rows, i.e., a 5×12 configuration. Although the first array 264 and second array 267 are described with these particular configurations, it is understood that alternative embodiments may employ array configurations with different numbers of columns and rows. In these alternative embodiments, the configurations may be randomly determined or depend on the wager placed by the player.

Each of the reels 262*a-e* is associated with a particular sequence of symbols 290, and each of the reels 264*a-e* is associated with a particular sequence of symbols 292. When the player triggers reels 262*a-e* and 265*a-e* according to one embodiment, the reels 262*a-e* and 265*a-e* rotate according to their associated sequence of symbols. The reels 262*a-e* and 265*a-e* resemble the mechanically rotating reels of a conventional slot machine.

In many respects, the first array 264 and the second array 267 are respectively similar to the first array 164 and the second array 167 described above. In this embodiment, however, the symbols 290 and 292 have a variety of sizes. While some symbols 290, 292 may occupy a single position 263, 266 in their respective array 264, 267, other symbols 290, 292 extend over multiple positions 263, 266 and may extend across multiple sub-arrays. For example, an Antony symbol 293 occupies three positions 263 of the reel 262*c*, and a Cleopatra symbol 294 occupies three positions 263 of the reel 262*e*. Meanwhile, an Antony symbol 295 occupies four positions 266 of the reel 264*b*, and a Cleopatra symbol 296 occupies four positions 266 of the reel 264*d*. According to aspects of the present invention, wild and/or bonus symbols may be represented by symbols that occupy multiple positions on a reel. For example, the Antony symbol 293 and the Cleopatra symbol 294 appearing in the first array 264 may individually or collectively function as wild symbols. The Antony symbol 293 or Cleopatra symbol 294 may be evaluated as a clump of three separate Antony or Cleopatra symbols, respectively. Because they occupy multiple positions of their respective reels, however, the Antony symbol 293 and/or the Cleopatra symbol 294 may optionally act like a clump of three wild symbols that each occupy one position in the reel. For example, paylines across each of the first three rows of the array 264 get the benefit of the wild Antony symbol 293. The Antony symbol 295 and the Cleopatra symbol 296 appearing in the second array 267 may also function as wild symbols.

Although the image of a symbol often indicates the function of the symbol, i.e., whether the symbol is a wild symbol, a bonus trigger, etc., some embodiments may specify that any symbol of a particular size has a given function. For example, a game may specify that all symbols occupying three positions of a reel are wild symbols.

In other embodiments, the function of a symbol also depends on which reel and/or array it appears. For example, a game may specify that symbols occupying more than two positions on a reel are wild symbols if they appear on particular reels of a particular array (e.g., reels 265*b-e* of the second array 267). In another example, a game may specify that bonus spins are awarded if two symbols occupying more than two positions appear consecutively on corresponding reels of different arrays (e.g., the reel 162*a* of the first array 264 or the reel 265*a* of the second array).

Like the game screen 160, symbols 290 from the first array 264 are selected and copied to positions in the second array 267. For example, when the wild Antony symbol 293 and the wild Cleopatra symbol 294 appear on the first array, they are copied to positions on the second array 267. As with the game screen 160, the second array 267 may be divided into sub-arrays and each sub-array may receive the symbol copied from the first array 264. Additionally, the sub-arrays may have a one-to-one mapping with the first array 264, and the symbols may be copied from the first array 264 according to this one-to-one mapping. Furthermore, one or more paylines may be individually selected in the first array 264 and/or the sub-arrays 268*a-c*. In other embodiments, one or more paylines are selected in the first array 264 and corresponding paylines are automatically mapped in mirror-like fashion to the sub-arrays. The combinations of the symbols along the paylines are evaluated for winning combinations.

Features of other embodiments described previously may be employed with the game screen 260. For example, a "Mega Wild" symbol may appear in the first array 264 to distribute a plurality of wild symbols to randomly selected positions 263 in the first array 264. These additional wild distributed by the "Mega Wild" symbol are also copied from the positions 263 in the first array 264 to corresponding positions 266 in the second array 267.

Figure 16:
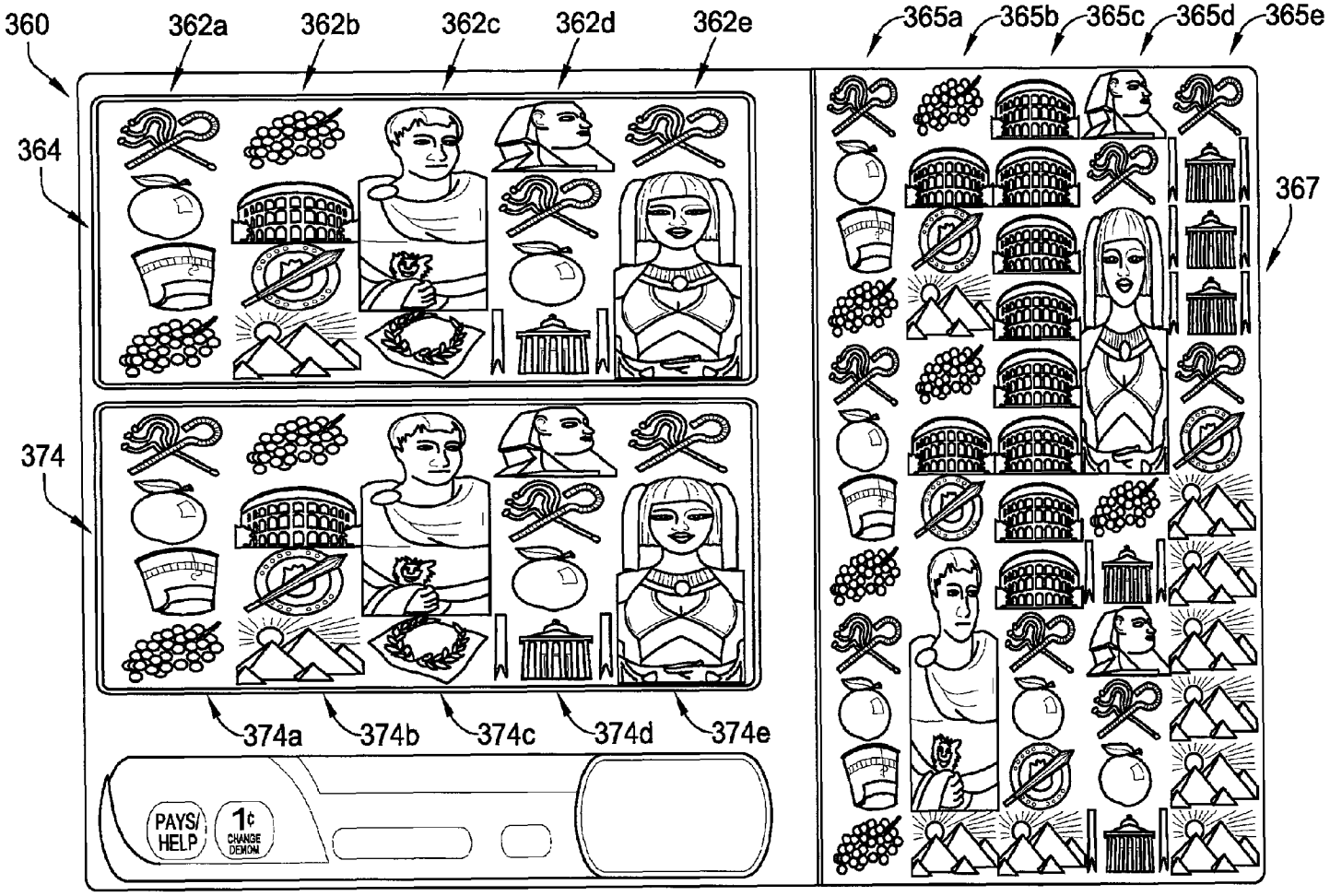
Figure 17:
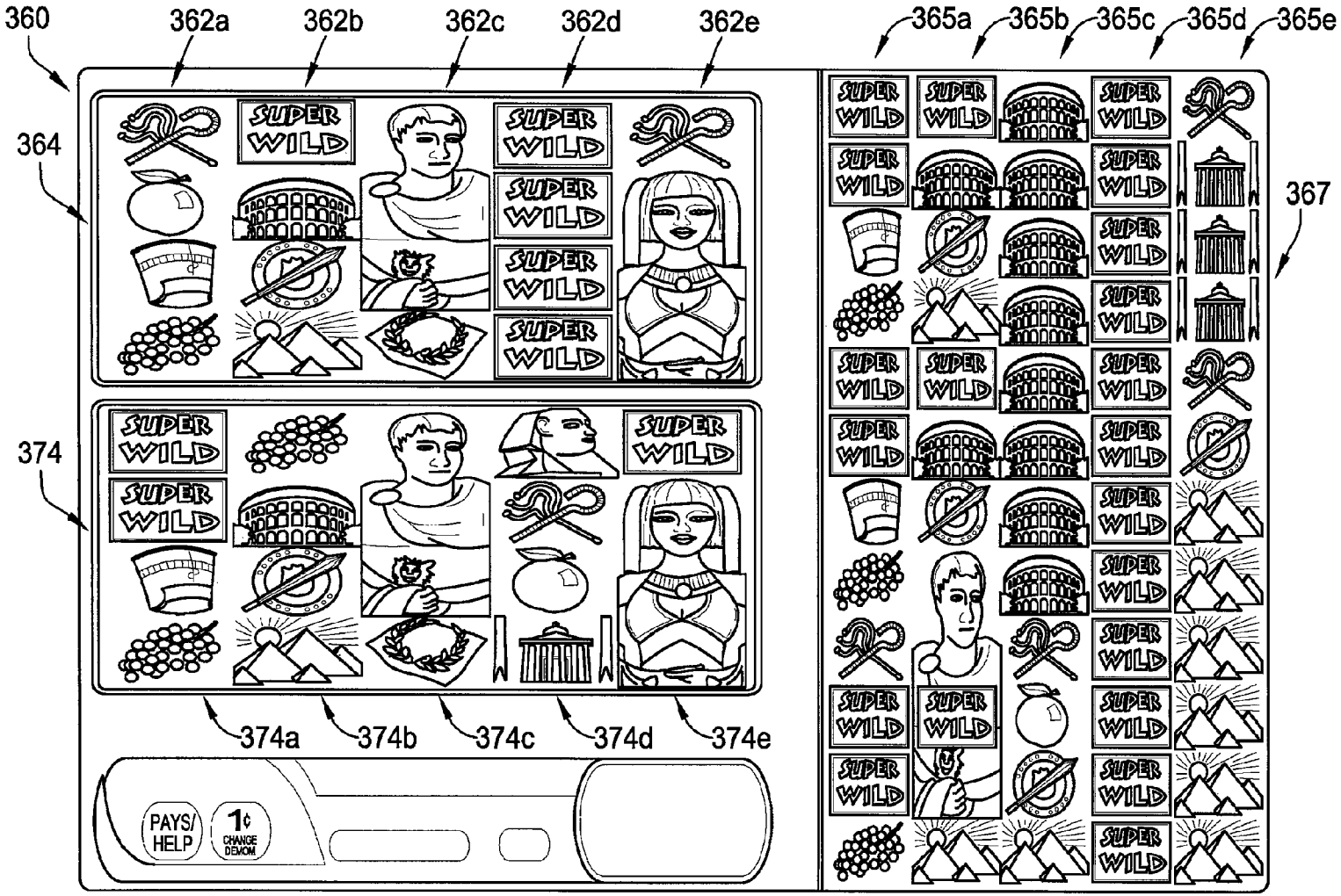

Although embodiments described above may include only two arrays, it is understood that other embodiments may employ more than two arrays. For example, the game screen 360 illustrated in FIGS. 16-17 employs three arrays 364, 367, and 374. The reels 362*a-e* and 372*a-e* provide a first array 364 and a second array 374 with five columns and four rows, i.e., a 5×4 configuration. The reels 365*a-e* provide a second array with five columns and twelve rows, i.e., a 5×12 configuration. Symbols selected from the first and second arrays 364, 374 may be copied to the third array 367. Symbol combinations across all three arrays 364, 367, and 374 are evaluated for winning combinations. In one example, FIG. 17 illustrates the results of spinning the reels 362*a-e*, 365*a-e*, and 372*a-e* during basic game play with the game screen 360. Bonus spins are awarded if the appropriate bonus symbols appear on the reels 362*a-e*, 365*a-e*, and 372*a-e*, e.g., if two symbols occupying more than two positions appear consecutively on the reel 364*a* of the first array 364, the reel 372*a* of the second array 374, or the reel 365*a* of the third array 367. During the bonus spins, wild symbols 391 appearing in the first and second arrays 364, 374 are copied to the third array 367. FIGS. 16-17 demonstrate that multiple arrays may be used to modify the symbols of a single array.

Accordingly, embodiments according to aspects of the present invention provide multiple reels that arrange symbols into multiple arrays to determine an outcome for a wagering game. To enhance the sense of anticipation during the wagering game, selected symbols are copied from one array to another. In some embodiments, the selected symbols are wild symbols. When the wild symbols are copied to other reel positions, the player perceives a greater likelihood of achieving a winning combination.

Figure 18:
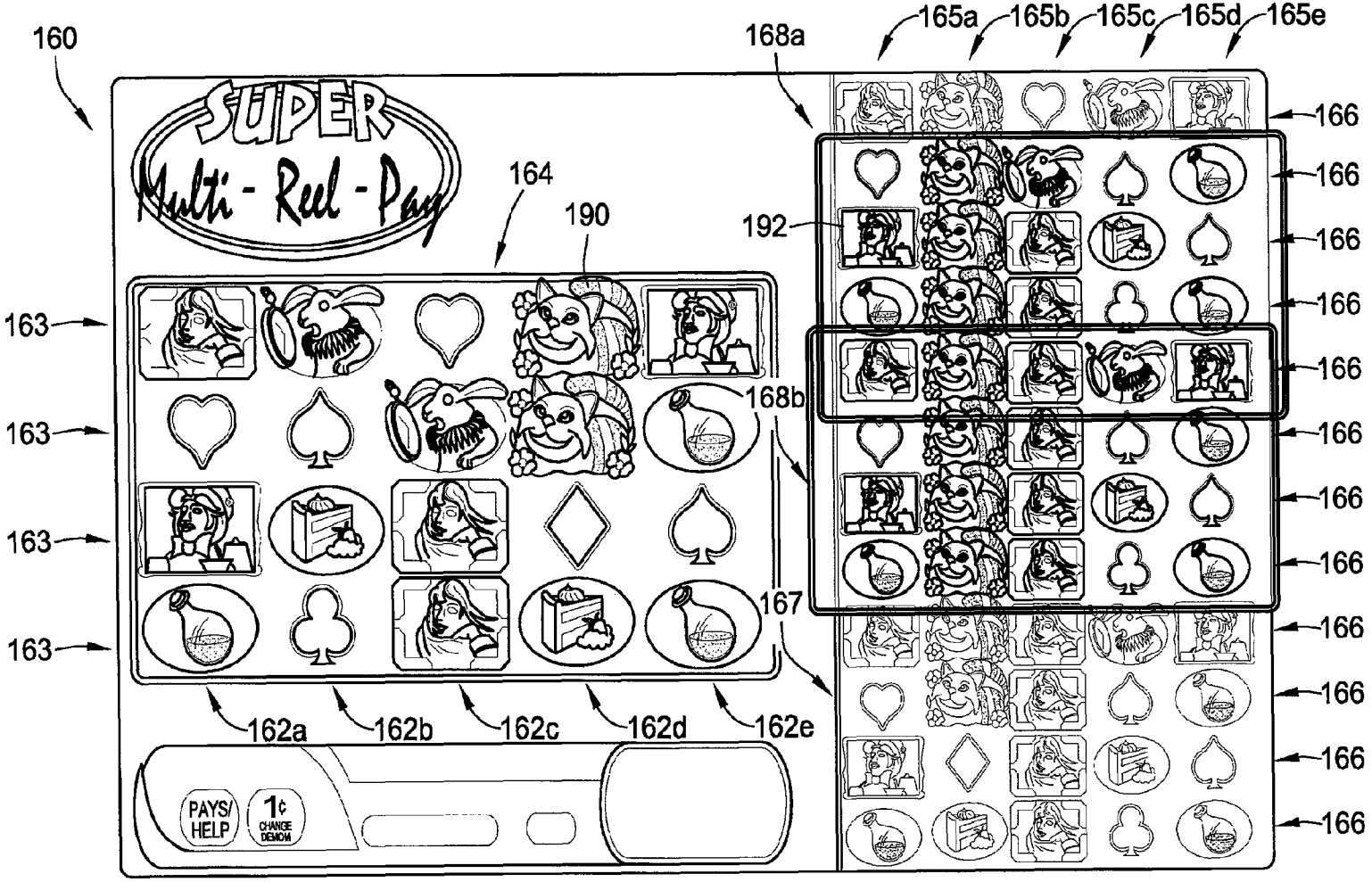

Although the embodiments above may evaluate arrays or sub-arrays that do not overlap, alternative embodiments combine overlapping arrays or sub-arrays with the concepts describe above. For example, referring to FIG. 18, the game screen 160 permits the selection of sub-arrays 168*a* and 168*b* as described with reference to FIG. 13, but in this alternative embodiment, the sub-arrays 168*a* and 168*b* overlap. In particular, the combination of symbols in each of the sub-arrays 168*a* and 168*b* share a common row. The symbols in the common row may be a part of one or more paylines in both sub-arrays 168*a* and 168*b*.

Figure 19:
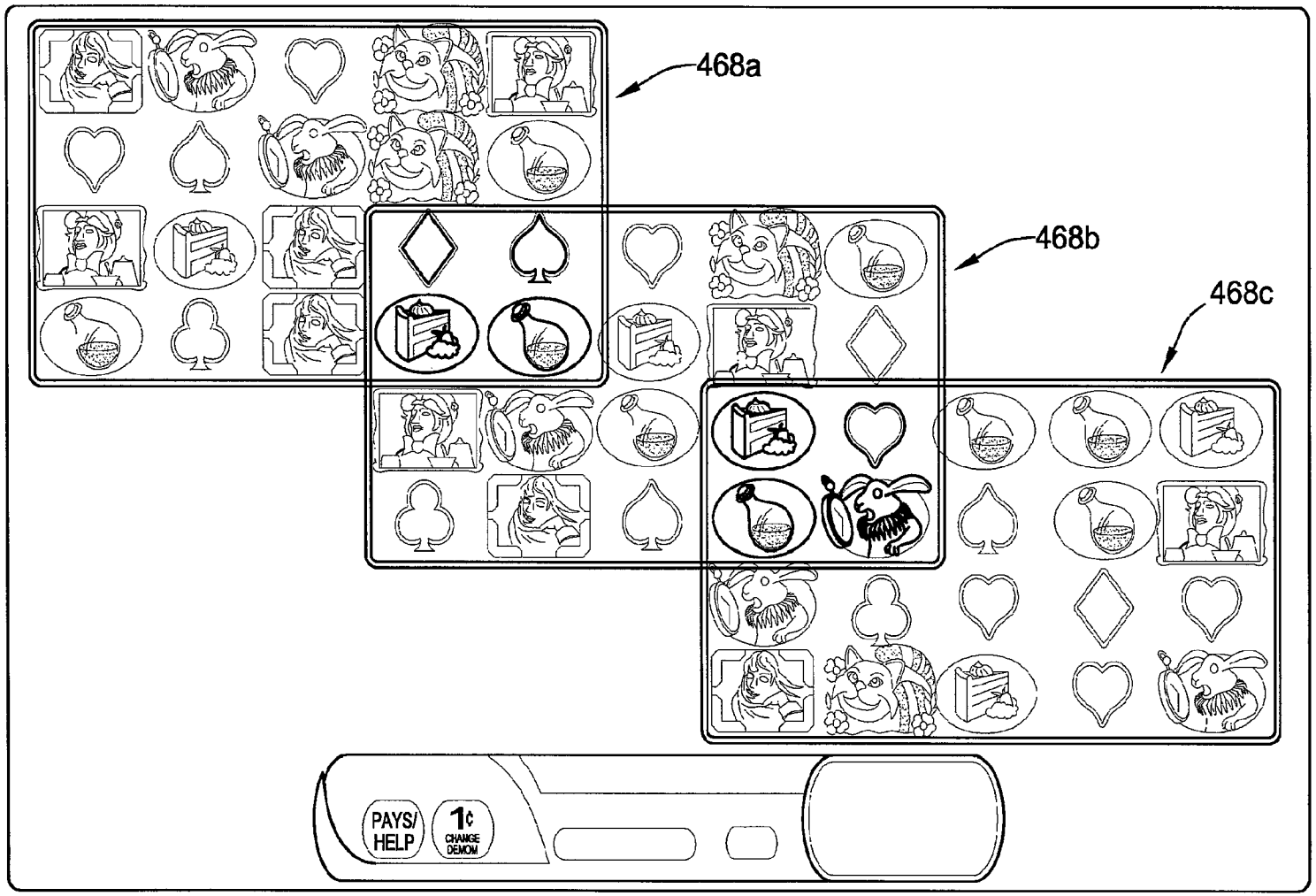

In addition to sharing a common row, overlapping arrays or sub-arrays may share a common row or any number/configuration of symbols. For example, FIG. 19 shows a configuration in which the corners of three arrays (or sub-arrays) 468*a-c* overlap. Specifically, array 468*a* and 468*b* share a 2×2 configuration of four symbols, and array 468*b* and 468 share another 2×2 configuration of four symbols. The shared symbols may affect the winning combinations of two or more arrays.

In some embodiments employing overlapping arrays, particular symbols that appear in the shared sections of the arrays may provide special features. For example, if a number of particular symbols appear in one of the shared sections, a bonus event may be triggered. In another example, if a wild symbol appears in one of the shared sections, the wild symbol expands to occupy other positions in the overlapping arrays, e.g., is copied to all positions in the reel.

Furthermore, a symbol that is shared by two or more arrays may be considered to appear a number of times equal to the number of arrays sharing the symbol. For example, if a bonus symbol is shared by three arrays, it is considered to appear three times. Thus, if three bonus symbols are required to trigger a bonus event, the bonus event is triggered even if it visually appears once.

As described previously, in some embodiments, the player may be required to place additional wagers to put each of the sub-arrays into play. In general, the player may be required to place wagers or make payments to put any aspect of the arrays into play. For example, certain reels or positions on the reels may be disabled until the player pays to unlock these reels or positions. In other embodiments, other types of event may have to occur before sections of the arrays are placed into play. For example, a particular symbol or combination of symbols may have to appear in one sub-array before the player can play paylines in another sub-array. As another example, a particular symbol or combination of symbols may have to appear in the first array before any part of the second array can be played. In other words, the appearance of particular symbol or combination of symbols may be required to unlock other parts of the arrays for game play.

In general, the availability of some features of the wagering game, e.g., selecting a size of an array or sub-array, may depend on the size of the wager. Other features, such as an expanding wild, may also depend on the size of the wager. For example, the player may be able to determine how many positions an expanding wild will expand if it appears in an array or sub-array.

In some embodiments, the pay table may depend on the size of the arrays or sub-arrays selected by the player or the controller 42, similar to a Keno game. Thus, smaller arrays provide fewer winning combinations, while larger arrays provide a greater variety of winning combinations.

Each of these embodiments and obvious variations thereof is contemplated as falling within the spirit and scope of the claimed invention, which is set forth in the following claims.

The invention claimed is:

1. A gaming system comprising:

a gaming machine primarily dedicated to playing at least one casino wagering game, the gaming machine including an electronic display device and one or more electronic input devices; and one or more controllers configured to:

detect via at least one of the one or more electronic input devices, a physical item associated with a monetary value that establishes a credit balance;

initiate the casino wagering game in response to an input indicative of a wager covered by the credit balance;

display on a display device, in response to the wager, a randomly-determined first array of symbols and a randomly-determined second array of symbols for the wagering game, the second array of symbols being larger than the first array of symbols;

select a symbol from the first array of symbols and copy the selected symbol into a plurality of different symbol positions in the second array of symbols to yield a modified second array of symbols;

evaluate the combinations of symbols in both the first array of symbols and in the modified second array of symbols to determine an outcome to the casino wagering game; and receive, via at least one of the one or more electronic input devices, a cashout input that initiates a payment from the credit balance.

2. The gaming system of claim 1, wherein the second array of symbols comprises a plurality of sub-arrays, and wherein the second array of symbols comprises at least one reel extending into each of the plurality of sub-arrays.

3. The gaming system of claim 1, wherein the casino wagering game is a base wagering game.

4. The gaming system of claim 1, wherein the first array and each of the plurality of sub-arrays of the second array of symbols include the same number of columns and rows, and wherein the selected symbol from the first array of symbols is copied to each of the plurality of sub-arrays.

5. The gaming system of claim 4, wherein the copying of the selected symbol from the first array of symbols into each of the plurality of sub-arrays of the second array of symbols is performed according to a one-to-one mapping between a symbol position of the selected symbol in the first array and a corresponding symbol position in each of the sub-arrays.

6. The gaming system of claim 1, wherein the one or more controllers select the selected symbol according to a symbol position of the selected symbol in the first array.

7. The gaming system of claim 1, wherein the second array is evenly into a plurality of sub-arrays.

8. The gaming system of claim 7, wherein the one or more controllers evaluate the combinations of symbols in the plurality of sub-arrays according to one or more paylines in each of the plurality of sub-arrays, the one or more paylines being determined by a selection of corresponding active paylines in the first array.

9. The gaming system of claim 1, wherein the one or more controllers are operative to select a plurality of symbols from the first array of symbols and to copy the selected plurality of symbols into symbol positions in the second array of symbols to yield a modified second array of symbols, the one or more controllers being configured evaluate the combinations of symbols in both the first array of symbols and in the modified second array of symbols to determine an outcome to the casino wagering game.

10. A casino gaming device primarily dedicated to playing at least one casino wagering game, comprising:

an electronic display device coupled to a gaming cabinet;

one or more electronic input devices coupled to the gaming cabinet; and one or more controllers configured to:

detect via at least one of the one or more electronic input devices, a physical item associated with a monetary value that establishes a credit balance;

initiate the casino wagering game in response to an input indicative of a wager covered by the credit balance;

display, in response to the wager, a first array of symbols and a separate second array of symbols for the casino wagering game, the first array of symbols including a first number of columns and a first number of rows and the second array of symbols including a second number of columns and a second number of rows, at least one of the second number of columns and the second number of rows being greater than the first number of columns or the first number of rows;

modify a plurality of symbol positions in the second array responsive to an occurrence of a special symbol in the first array, the modification of the second array comprising a replacing of respective symbols in the plurality of symbol positions in the second array with the special symbol from the first array;

evaluate the combinations of symbols in the first array and the modified second array to determine an outcome to the casino wagering game; and receive, via at least one of the one or more electronic input devices, a cashout input that initiates a payment from the credit balance.

11. The gaming device of claim 10, wherein the first array comprises a first reel including a predetermined sequence of symbols and the second array comprises a second reel including a predetermined sequence of symbols.

12. The gaming device of claim 10, wherein the special symbol is a wild symbol or a bonus symbol.

13. The gaming device of claim 10, wherein the second array is divided into a plurality of sub-arrays, and wherein the one or more controllers are configured to copy the special symbol into each sub-array of the plurality of sub-arrays.

14. The gaming device of claim 10, wherein each of the plurality of sub-arrays includes the first number of columns and the first number of rows.

15. The gaming device of claim 14, wherein the copying of the special symbol into each sub-array of the plurality of sub-arrays is performed according to a one-to-one mapping between a symbol position of the special symbol in the first array and a corresponding symbol position in each of the sub-arrays.

16. A computer-implemented method of operating a gaming system, the gaming system including one or more controllers and a gaming machine, the gaming machine primarily dedicated to playing at least one casino wagering game, the gaming machine including one or more electronic display devices and one or more electronic input devices, the method comprising:

detecting, via at least one of the one or more electronic input devices, a physical item associated with a monetary value that establishes a credit balance;

initiating the casino wagering game in response to an input indicative of a wager covered by the credit balance;

concurrently displaying, on the one or more display devices, a first array of symbols and a separate second array of symbols for the wagering game, the first array of symbols including a first number of columns and a first number of rows and the second array of symbols including a second number of columns and a second number of rows, at least one of the second number of columns and the second number of rows being greater than the first number of columns or the first number of rows;

modifying, using the one or more controllers, a plurality of symbol positions in the second array responsive to each occurrence of a special symbol in the first array, the modification of the second array comprising a replacing of a plurality of symbols in a corresponding plurality of symbol positions in the second array with said each special symbol from the first array; and evaluating, using the one or more controllers, a game outcome from the combinations of symbols in the first array and the modified second array; and receiving, via at least one of the one or more electronic input devices, a cashout input that initiates a payment from the credit balance.

17. The computer-implemented method of claim 16, wherein the special symbol is a wild symbol or a bonus symbol.

18. The computer-implemented method of claim 16, wherein the second array is divided into a plurality of sub-arrays, and wherein the one or more controllers are configured to copy the special symbol into each sub-array of the plurality of sub-arrays.

19. The computer-implemented method of claim 16, wherein each of the plurality of sub-arrays includes the first number of columns and the first number of rows.

20. The gaming device of claim 19, the act of modifying a plurality of symbol positions in the second array responsive to each occurrence of a special symbol in the first array further comprising a one-to-one mapping between a symbol position of the special symbol in the first array and a corresponding symbol position in each of the sub-arrays.

* * * * *